US011781732B2

(12) United States Patent
Lim et al.

(10) Patent No.: US 11,781,732 B2
(45) Date of Patent: Oct. 10, 2023

(54) LIGHTING FIXTURE WITH LENS ASSEMBLY FOR REDUCED GLARE

(71) Applicant: IDEAL Industries Lighting LLC, Racine, WI (US)

(72) Inventors: Jin Hong Lim, Morrisville, NC (US); Mark P. Boomgaarden, Cary, NC (US)

(73) Assignee: IDEAL Industries Lighting LLC, Racine, WI (US)

( * ) Notice: Subject to any disclaimer, the term of this patent is extended or adjusted under 35 U.S.C. 154(b) by 0 days.

(21) Appl. No.: 17/559,685

(22) Filed: Dec. 22, 2021

(65) Prior Publication Data

US 2023/0194068 A1 Jun. 22, 2023

(51) Int. Cl.

| | |
|---|---|
| ***F21V 5/04*** | (2006.01) |
| ***F21V 7/04*** | (2006.01) |
| ***F21S 4/28*** | (2016.01) |
| *F21Y 103/10* | (2016.01) |
| *F21Y 115/10* | (2016.01) |

(52) U.S. Cl.

CPC ..... *F21V 5/04* (2013.01); *F21S 4/28* (2016.01); *F21V 7/048* (2013.01); *F21Y 2103/10* (2016.08); *F21Y 2115/10* (2016.08)

(58) Field of Classification Search

CPC ..... F21V 3/02; F21V 3/049; F21V 3/0615; F21V 3/0625; F21Y 2103/10; F21S 8/026

See application file for complete search history.

(56) References Cited

U.S. PATENT DOCUMENTS

| | | | | |
|---|---|---|---|---|
| 5,384,693 | A | 1/1995 | Schwaller et al. | |
| 6,924,943 | B2 * | 8/2005 | Minano | G02B 3/08 359/743 |
| 7,559,672 | B1 | 7/2009 | Parkyn et al. | |
| 7,874,697 | B2 | 1/2011 | Biebel et al. | |
| 8,210,165 | B2 * | 7/2012 | Forrester | G02B 7/008 136/246 |
| 8,310,143 | B2 | 11/2012 | Van De Ven et al. | |

(Continued)

OTHER PUBLICATIONS

U.S. Appl. No. 61/932,058, filed Jan. 27, 2014.

(Continued)

*Primary Examiner* — Tracie Y Green
*Assistant Examiner* — Michael Chiang
(74) *Attorney, Agent, or Firm* — Withrow & Terranova, P.L.L.C.

(57) ABSTRACT

A lighting fixture with reduced glare is provided. Lighting fixtures described herein use a lens assembly to redirect light away from a housing in order to reduce a unified glaring ratio (UGR) (e.g., when viewed crosswise or endwise). The lens assembly may further provide diffusive properties which result in a more pleasing and soft light over traditional lighting fixtures. In aspects described herein, the UGR of troffer-style lighting fixtures can be improved (e.g., reduced) through lens assemblies having one or more light redirection features configured to particularly redirect light emitted at high v-angles (e.g., light emitted sideways relative to the housing at v-angles greater than 70 degrees). For example, the lens assembly may include an inner prismatic surface of a lens, an inner lens, a louver assembly (e.g., over or under a lens), or a reflector to achieve this light redirection.

22 Claims, 18 Drawing Sheets

(56) References Cited

U.S. PATENT DOCUMENTS

| | | | | |
|---|---|---|---|---|
| 8,736,186 | B2 | 5/2014 | Chobot | |
| 8,829,821 | B2 | 9/2014 | Chobot et al. | |
| 8,912,735 | B2 | 12/2014 | Chobot et al. | |
| 8,975,827 | B2 | 3/2015 | Chobot et al. | |
| 9,155,165 | B2 | 10/2015 | Chobot | |
| 9,155,166 | B2 | 10/2015 | Chobot | |
| 9,433,061 | B2 | 8/2016 | Chobot | |
| 9,476,566 | B2 * | 10/2016 | Lu | F21V 13/04 |
| 9,572,226 | B2 | 2/2017 | Motley et al. | |
| 9,622,321 | B2 | 4/2017 | Creasman et al. | |
| 9,786,639 | B2 | 10/2017 | Bergmann et al. | |
| 9,818,919 | B2 | 11/2017 | Lowes et al. | |
| 9,900,957 | B2 | 2/2018 | van de Ven et al. | |
| 10,161,612 | B2 | 12/2018 | Chobot et al. | |
| 10,203,088 | B2 | 2/2019 | Lay et al. | |
| 10,247,372 | B2 * | 4/2019 | Wilcox | F21V 5/04 |
| 10,278,250 | B2 | 4/2019 | McBryde et al. | |
| 10,323,824 | B1 * | 6/2019 | Lim | F21V 5/02 |
| 10,412,809 | B2 | 9/2019 | van de Ven et al. | |
| 10,451,229 | B2 | 10/2019 | Keller et al. | |
| 10,465,869 | B2 | 11/2019 | Keller et al. | |
| 10,502,374 | B2 | 12/2019 | Leung et al. | |
| 10,508,794 | B2 | 12/2019 | Lim et al. | |
| 10,527,785 | B2 | 1/2020 | Tarsa et al. | |
| 10,529,900 | B2 | 1/2020 | Zhang et al. | |
| 10,648,643 | B2 * | 5/2020 | Edmond | F21V 7/005 |
| 11,002,425 | B1 * | 5/2021 | Chen | F21V 5/002 |
| 11,079,079 | B2 | 8/2021 | Lim et al. | |
| 2003/0156416 | A1 | 8/2003 | Stopa et al. | |
| 2008/0278943 | A1 | 11/2008 | Van Der Poel | |
| 2010/0177526 | A1 * | 7/2010 | Futami | G02B 3/08 362/519 |
| 2011/0141721 | A1 * | 6/2011 | Kato | F21V 5/08 362/217.05 |
| 2011/0222279 | A1 | 9/2011 | Kim et al. | |
| 2012/0299017 | A1 | 11/2012 | Chen et al. | |
| 2013/0201675 | A1 | 8/2013 | Linehan et al. | |
| 2013/0258245 | A1 | 10/2013 | Fang | |
| 2014/0268790 | A1 | 9/2014 | Chobot et al. | |
| 2014/0347885 | A1 | 11/2014 | Wilcox et al. | |
| 2015/0029717 | A1 * | 1/2015 | Shen | F21V 3/049 362/297 |
| 2016/0061413 | A1 | 3/2016 | Hedberg, Jr. | |
| 2016/0305619 | A1 | 10/2016 | Howe | |
| 2017/0268744 | A1 * | 9/2017 | Hsia | F21V 3/02 |
| 2018/0010770 | A1 * | 1/2018 | Bao | F21V 13/04 |
| 2018/0172246 | A1 | 6/2018 | Walker et al. | |
| 2020/0088387 | A1 | 3/2020 | Lim et al. | |
| 2021/0332968 | A1 * | 10/2021 | Cerv | G02B 6/0045 |
| 2022/0178506 | A1 * | 6/2022 | Amin | F21V 5/02 |

OTHER PUBLICATIONS

U.S. Appl. No. 62/292,528, filed Feb. 8, 2016.

Cree Lighting, "C-Lite® C-TR-A-BT24 Series LED Basket Troffer 2'×4' Spec Sheet", Jun. 8, 2020, pp. 1-3, obtained from Internet: https://www.creelighting.com/Coveo_Restlsearchresults/indexall?searchCollection=%40syscollection%3Dlighting&q=troffer#q=troffer&sort=relevancy.

Cree Lighting, "Cree FLEX Series LED Spec-Grade Troffer Sales Sheet", Jan. 10, 2019, pp. 1-2, obtained from Internet: https://www.creelighting.com/Coveo_Rest/searchresults/indexall?searchCollection=%40syscollection%3Dlighting&q=troffer#q=troffer&sort=relevancy.

Cree Lighting, "Flex Series Spec-Grade Troffer sales sheet", Jan. 10, 2019, pp. 1-4, obtained from Internet: https://www.creelighting.com/Coveo_Restlsearchresults/indexall?searchCollection=%40syscollection%3Dlighting&q=troffer#q#troffer&sort=relevancy.

Cree Lighting, "Surface Mount Kit Installation Instructions for CR Troffers", Jan. 10, 2020, pp. 1-2, obtained from Internet: https://www.creelighting.com/Coveo_Restlsearchresults/indexall?searchCollection=%40syscollection%3Dlighting&q=troffer#q=troffer&sort=relevancy.

Cree Lighting, "ZR Series Troffer Sales Sheet", Jun. 5, 2017, pp. 1-2, obtained from Internet: https://www.creelighting.com/Coveo_Rest/searchresults/indexall?searchCollection=%40syscollection%3Dlighting&q=troffer#q=troffer&sort=relevancy.

Natural Resources Canada, "Lighting for Health and Energy Savings", The Lighting Energy Alliance and Light and Health Alliance at the Lighting Research Center, Mar. 1, 2019, pp. 1-7, Rensselaer Polytechnic Institute.

Non-Final Office Action for U.S. Appl. No. 15/846,255, dated Sep. 18, 2018, 7 pages.

Notice of Allowance for U.S. Appl. No. 15/846,255, dated Feb. 14, 2019, 7 pages.

Notice of Allowance for U.S. Appl. No. 16/937,026, dated Apr. 21, 2021, 8 pages.

* cited by examiner

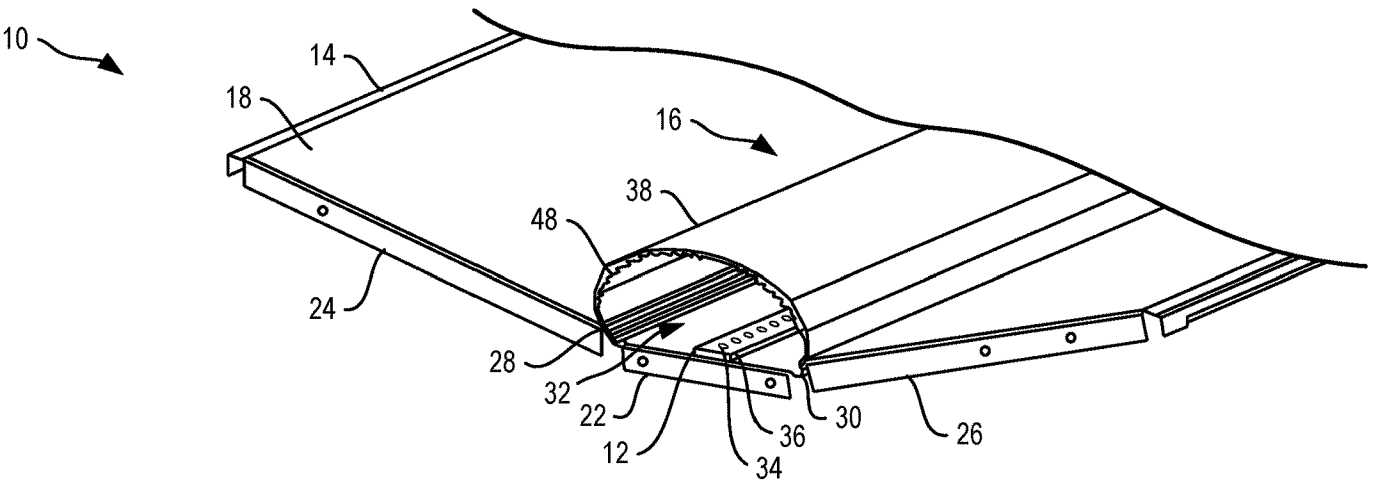
FIG. 3A
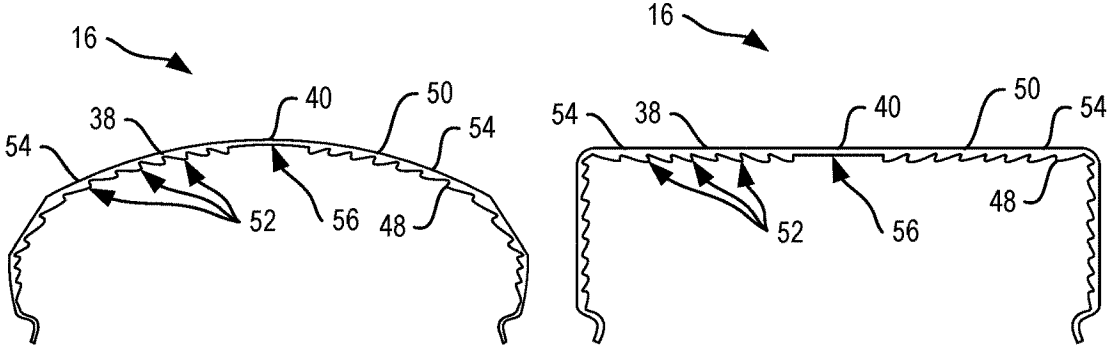
FIG. 3B
FIG. 3C
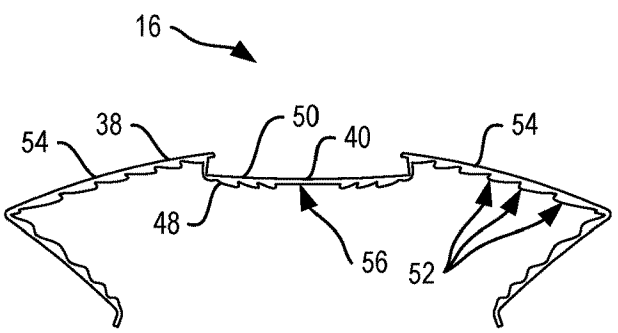
FIG. 3D

LIGHTING FIXTURE WITH LENS ASSEMBLY FOR REDUCED GLARE

FIELD OF THE DISCLOSURE

The present disclosure relates to lighting fixtures, and more particularly to reducing glare in lighting fixtures with solid state light sources.

BACKGROUND

Lighting fixtures are frequently used to illuminate residential, commercial, office and industrial spaces. In many instances, troffer lighting fixtures are used, which house elongated fluorescent light bulbs to provide illumination. Troffer lighting fixtures can be used in a wide variety of applications, including but not limited to being mounted to or suspended from a ceiling or being recessed into the ceiling with their back side protruding into a plenum area above the ceiling. Elements on the back side of the troffer lighting fixture may dissipate heat generated by the light source into the plenum where air can be circulated to facilitate the cooling mechanism.

More recently, with the advent of efficient solid state lighting sources, troffer and other styles of lighting fixtures have been used with light-emitting diodes (LEDs). LEDs have certain characteristics that make them desirable for many lighting applications that were previously the realm of incandescent or fluorescent lights. LEDs can emit the same luminous flux as incandescent and fluorescent lights using a fraction of the energy. In addition, LEDs can have a significantly longer operational lifetime than these traditional light sources.

In some cases, LED-based lighting fixtures distribute light in an asymmetric fashion, which can result in undesirably high levels of glare. For example, a unified glaring ratio (UGR) can measure glare in a crosswise direction (the direction perpendicular to a linear LED array) and/or an endwise direction (the direction parallel to the LED array). When a lighting fixture emits strong light in high v-angles (where light is emitted downward relative to the ceiling), this can result in a high endwise and/or crosswise UGR.

SUMMARY

A lighting fixture with reduced glare is provided. Lighting fixtures described herein use a lens assembly to redirect light away from a housing in order to reduce a unified glaring ratio (UGR) (e.g., when viewed crosswise or endwise). The lens assembly may further provide diffusive properties which result in a more pleasing and soft light over traditional lighting fixtures. In aspects described herein, the UGR of troffer-style lighting fixtures can be improved (e.g., reduced) through lens assemblies having one or more light redirection features configured to particularly redirect light emitted at high v-angles (e.g., light emitted sideways relative to the housing at v-angles greater than 70 degrees). For example, the lens assembly may include an inner prismatic surface of a lens, an inner lens, a louver assembly (e.g., over or under a lens), or a reflector to achieve this light redirection.

An exemplary embodiment provides a lighting fixture. The lighting fixture includes a housing comprising a back pan, a light engine coupled to the back pan and comprising a plurality of light emitting diode (LED) elements, and a lens assembly coupled to the housing and extending over the light engine. The lens assembly is configured to redirect light from the light engine away from the housing to reduce a UGR of the lighting fixture.

An exemplary embodiment provides a lighting fixture. The lighting fixture includes a housing comprising a back pan, a light engine coupled to the back pan and comprising a plurality of LED elements, and a lens coupled to the housing and extending over the light engine. The lens has a prismatic inner surface facing the light engine.

An exemplary embodiment provides a lighting fixture. The lighting fixture includes a housing comprising a back pan, a light engine coupled to the back pan and comprising a plurality of LED elements, an outer lens coupled to the housing and extending over the light engine, and an inner lens between the outer lens and the light engine. The inner lens is configured to redirect light from the light engine away from the housing.

An exemplary embodiment provides a lighting fixture. The lighting fixture includes a housing comprising a back pan, a light engine coupled to the back pan and comprising a plurality of LED elements, a lens coupled to the housing and extending over the light engine, and a louver assembly disposed over the light engine and configured to redirect light from the light engine away from the housing.

An exemplary embodiment provides a lighting fixture. The lighting fixture includes a housing comprising a back pan, a light engine coupled to the back pan and comprising a plurality of LED elements, a lens coupled to the housing and extending over the light engine, and a reflector disposed about the light engine and under the lens. The reflector is configured to redirect light from the light engine away from the housing.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

FIG. 3A is a schematic diagram of a troffer lighting fixture having a lens assembly with a prismatic inner surface for redirecting light according to a first aspect described herein.

FIG. 3B is a cross-sectional view of a curved lens with a prismatic inner surface for the troffer lighting fixture of FIG. 3A.

FIG. 3C is a cross-sectional view of a square lens with a prismatic inner surface for the troffer lighting fixture of FIG. 3A.

FIG. 3D is a cross-sectional view of an architectural lens with a prismatic inner surface for the troffer lighting fixture of FIG. 3A.

DETAILED DESCRIPTION

Figure 1:
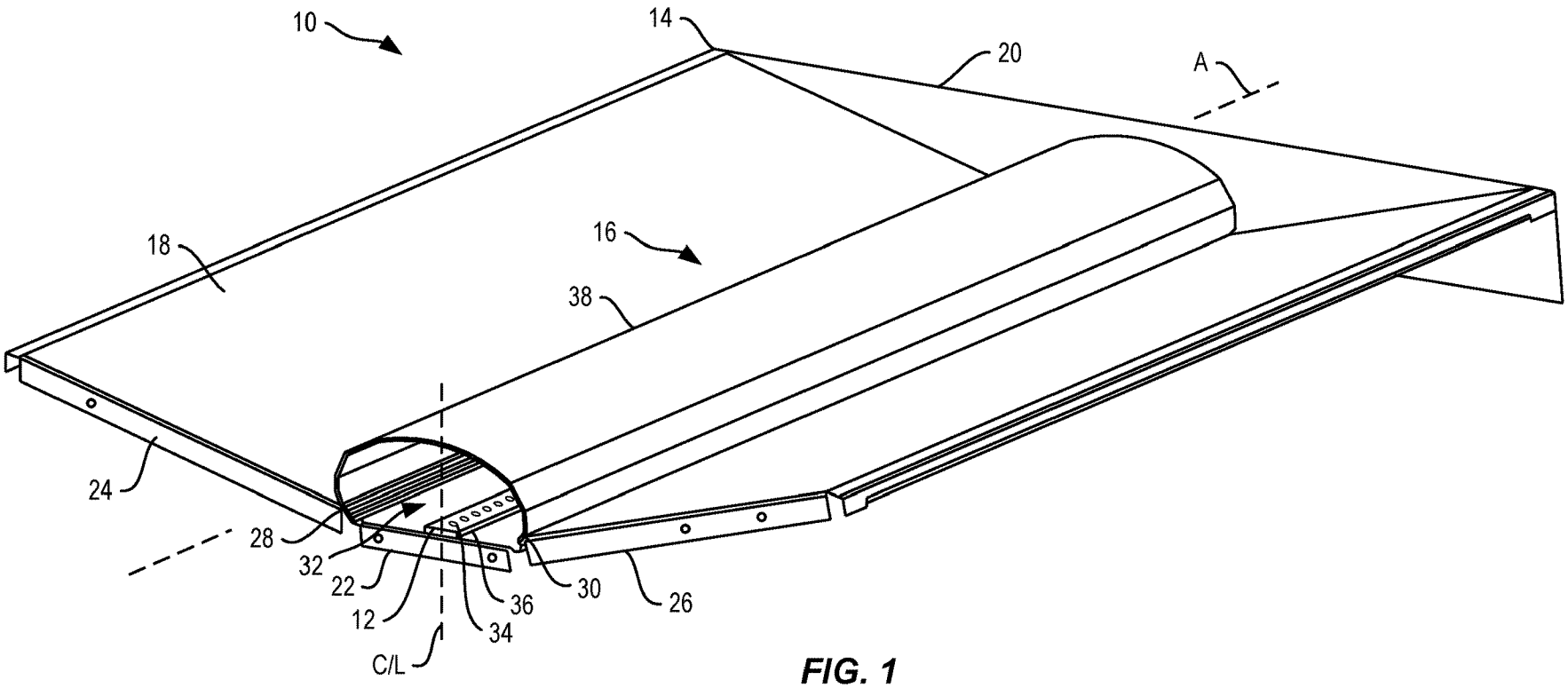
FIG. 1 is a schematic diagram of an exemplary troffer lighting fixture according to embodiments described herein.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

A lighting fixture with reduced glare is provided. Lighting fixtures described herein use a lens assembly to redirect light away from a housing in order to reduce a unified glaring ratio (UGR) (e.g., when viewed crosswise or endwise). The lens assembly may further provide diffusive properties which result in a more pleasing and soft light over traditional lighting fixtures. In aspects described herein, the UGR of troffer-style lighting fixtures can be improved (e.g., reduced) through lens assemblies having one or more light redirection features configured to particularly redirect light emitted at high v-angles (e.g., light emitted sideways relative to the housing at v-angles greater than 70 degrees). For example, the lens assembly may include an inner prismatic surface of a lens, an inner lens, a louver assembly (e.g., over or under a lens), or a reflector to achieve this light redirection.

FIG. 1 is a schematic diagram of an exemplary troffer lighting fixture 10 according to embodiments described herein. In some embodiments, the lighting fixture 10 is configured to be mounted on a ceiling or other elevated position to direct light vertically downward (e.g., away from a light engine 12) onto a target area. The lighting fixture 10 may be mounted within a T grid by being placed on the supports of the T grid. In some examples, additional attachments, such as tethers, may be included to stabilize the fixture in case of earthquakes or other disturbances. In some examples, the lighting fixture 10 may be suspended by cables, recessed into a ceiling or mounted on another support structure.

The lighting fixture 10 includes a housing 14, a light engine 12, and a lens assembly 16. The housing 14 includes a back pan 18 and may further include an end cap 20 secured at each end (shown here with only one end cap). The back pan 18 and end caps 20 form a recessed pan style troffer housing defining an interior space for receiving the light engine 12. In one example, the back pan 18 includes three separate sections including a center section 22, a first wing 24, and a second wing 26. In one example, each of the center section 22, first wing 24, second wing 26, and end caps 20 is made of multiple sheet metal components secured together. In another example, the back pan 18 is made of a single piece of sheet material that is attached to the end caps 20. In another example, the back pan 18 and end caps 20 are made from a single piece of sheet metal formed into the desired shape. In examples with multiple pieces, the pieces are connected together in various manners, including but not limited to mechanical fasteners and welding.

In some examples, the housing 14 includes the back pan 18, but does not include end caps 20. The exposed surfaces of the back pan 18 and end caps 20 may be made of a metal (e.g., aluminum (Al)), plastic, or other rigid material. The exposed surfaces may also include diffusing components if desired. For many lighting applications, it is desirable to present a uniform, soft light source without unpleasant glare, color striping, or hot spots. Thus, one or more sections of the housing 14 can be coated with a reflective material, such as a microcellular polyethylene terephthalate (MCPET) material or a Du Pont/WhiteOptics material, for example. Other white diffuse reflective materials can also be used. One or more sections of the housing 14 may also include a diffuse white coating.

The lens assembly 16 is attached to the housing 14 and extends over the light engine 12. A first outer end 28 of the lens assembly 16 may be positioned at the first wing 24 of the back pan 18 and a second outer end 30 of the lens assembly 16 may be positioned at the second wing 26. In one example, the outer ends 28, 30 abut against the respective wings 24, 26, and can be connected by one or more of mechanical fasteners, a tongue and grove, adhesives, and so on. In another example, the outer ends 28, 30 are spaced away from the respective wings 24, 26.

According to embodiments described herein, the lens assembly 16 is configured to redirect light from the light engine 12 away from the housing 14 (e.g., downward when the lighting fixture 10 is installed in a ceiling) to reduce the UGR of the lighting fixture 10. In some examples, the lens assembly 16 reduces the UGR of the lighting fixture 10 when viewed both endwise and crosswise. This is further described with reference to exemplary embodiments in Sections I-IV below.

The housing 14 and lens assembly 16 form an interior space 32 that houses the light engine 12. In some embodiments, the interior space 32 is partially or fully sealed to protect the light engine 12 and prevent the ingress of water and/or debris. For example, the lighting fixture 10 may be designed for indoor use and the interior space 32 may be sealed to protect the light engine 12 from debris, insects, and so on.

In an exemplary aspect, the light engine 12 is a solid-state light engine, which may include multiple light emitting diode (LED) elements 34. The light engine 12 may be aligned in an elongated manner that extends along the back pan 18. In one example, the light engine 12 extends the entire length of the back pan 18 between the end caps 20. In another example, the light engine 12 extends a lesser distance and is spaced away from one or both of the end caps 20. In one example, the light engine 12 is aligned with the longitudinal axis A (FIG. 1) of the lighting fixture 10 and is mounted to the center section 22 of the back pan 18.

The light engine 12 includes the LED elements 34 and a substrate 36. The LED elements 34 can be arranged in a variety of different arrangements. In one example as illustrated in FIG. 1, the LED elements 34 are aligned in a linearly arrayed row. In another example, the LED elements 34 are aligned in two or more linearly arrayed rows. The LED elements 34 can be arranged at various spacings. In one example, the LED elements 34 are equally spaced along the length of the back pan 18. In another example, the LED elements 34 are arranged in clusters at different spacings along the back pan 18.

The light engine 12 can include the same or different types of LED elements 34. In one example, the multiple LED elements 34 are similarly colored (e.g., all warm white LED elements 34). In such an example, all of the LED elements 34 are intended to emit at a similar targeted wavelength; however, in practice there may be some variation in the emitted color of each of the LED elements 34 such that the LED elements 34 may be selected such that light emitted by the LED elements 34 is balanced such that the lighting fixture 10 emits light at the desired color point.

In one example, each LED element 34 is a single white or other color LED chip or other bare component. In another example, each LED element 34 includes multiple LEDs either mounted separately or together. In the various embodiments, the LED elements 34 can include, for example, at least one phosphor-coated LED either alone or in combination with at least one color LED, such as a green LED, a yellow LED, a red LED, etc. In various examples, the LED elements 34 of similar and/or different colors may be selected to achieve a desired color point.

In one example, the light engine 12 includes different LED elements 34. Examples include blue-shifted-yellow LED elements ("BSY") and red LED elements ("R"). Once properly mixed the resultant output light will have a "warm white" appearance. Another example uses a series of clusters having three BSY LED elements 34 and a single red LED element 34. This scheme will also yield a warm white output when sufficiently mixed. Another example uses a series of clusters having two BSY LED elements 34 and two red LED elements 34. This scheme will also yield a warm white output when sufficiently mixed. In other examples, separate BSY LED elements 34 and a green LED element 34 and/or blue-shifted-red LED element 34 and a green LED element 34 are used. Details of suitable arrangements of the LED elements 34 and electronics for use in the lighting fixture 10 are disclosed in U.S. Pat. No. 9,786,639, which is incorporated by reference herein in its entirety.

The light engine 12 includes the substrate 36 that supports and positions the LED elements 34. The substrate 36 can include various configurations, including but not limited to a printed circuit board and a flexible circuit board. The substrate 36 can include various shapes and sizes depending upon the number and arrangement of the LED elements 34.

In some embodiments, the light engine 12 is centered along a centerline C/L of the lighting fixture 10. In addition, the lens assembly 16 may also be positioned along the centerline C/L. The centerline C/L also extends through the center of the back pan 18, which can include the center of the center section 22.

Each LED element 34 receives power from an LED driver circuit or power supply of suitable type, such as a SEPIC-type power converter and/or other power conversion circuits. At the most basic level a driver circuit may comprise an AC-to-DC converter, a DC-to-DC converter, or both. In one example, the driver circuit comprises an AC-to-DC converter and a DC-to-DC converter. In another example, the AC-to-DC conversion is done remotely (i.e., outside the fixture), and the DC-to-DC conversion is done at the driver circuit locally at the lighting fixture 10. In yet another example, only AC-to-DC conversion is done at the driver circuit at the lighting fixture 10. Some of the electronic circuitry for powering the LED elements 34 such as the driver and power supply and other control circuitry may be contained as part of the light engine 12 or the electronics may be supported separately from the light engine 12.

In one example, a single driver circuit is operatively connected to the LED elements 34. In another example, two or more driver circuits are connected to the LED elements 34. In one example, the light engine 12 is mounted on a heat sink (e.g., such as the back pan 18 or a separate heat sink, not shown) that transfers away heat generated by the LED elements 34. The heat sink can provide a surface that contacts against and supports the substrate 36. The heat sink can further include one or more fins or other thermal elements for dissipating the heat. The heat sink cools the LED elements 34, allowing for operation at desired temperature levels. It should be understood that many different heatsink structures could be used with embodiments described herein.

In one example, the substrate 36 is attached directly to the housing 14. In one specific example, the substrate 36 is attached to the back pan 18. The substrate 36 can be attached to the center section 22, or to one of the first and second wings 24, 26. The attachment provides for the light engine 12 to be thermally coupled to the housing 14. The thermal coupling provides for heat produced by the LED elements 34 to be transferred to and dissipated through the housing 14.

Examples of troffer lighting fixtures 10 with a housing 14 and light engine 12 are disclosed in: U.S. Pat. Nos. 10,508,794, 10,247,372, and 10,203,088, each of which is hereby incorporated by reference in its entirety.

In various embodiments described herein, the lens assembly 16 includes a lens 38, which may be considered an outer lens 38 of the lighting fixture 10. As will be described in greater detail below, the lens 38 is generally suspended over the light engine 12. The lens 38 can be shaped according to performance and/or aesthetic considerations. Example shapes are illustrated in FIGS. 2A-2C.

Figure 2A:
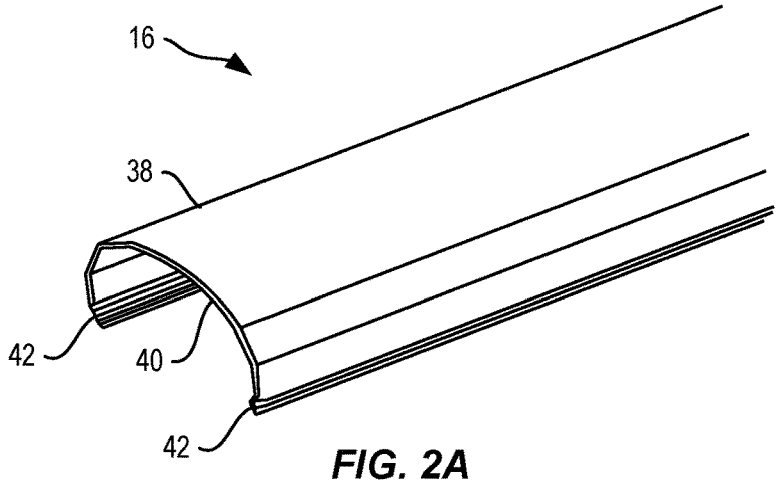
FIG. 2A is a schematic diagram of a curved lens for the troffer lighting fixture of FIG. 1.

FIG. 2A is a schematic diagram of a curved lens 38 for the troffer lighting fixture 10 of FIG. 1. The curved lens 38 may include a center region 40 disposed over the light engine 12 which is curved or cylindrical and ends 42 which are shaped to attach to the housing 14 (e.g., with a tongue-and-groove, a fastener, or similar mechanical attachment).

Figure 2B:
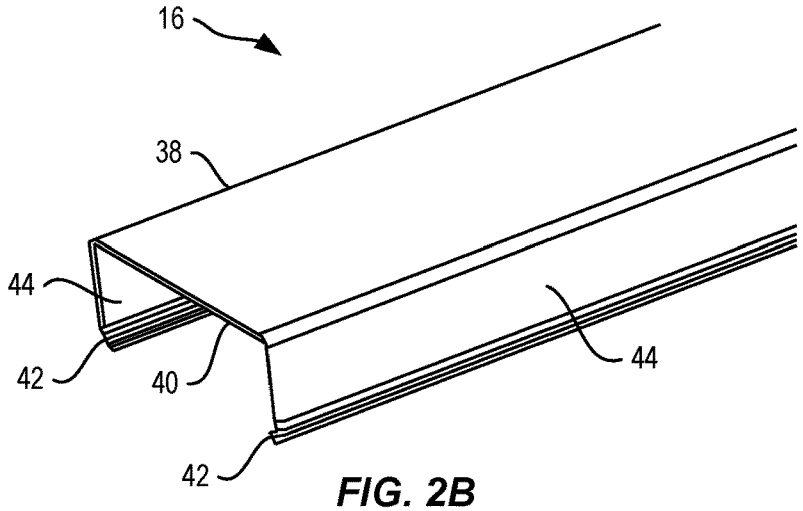
FIG. 2B is a schematic diagram of a square lens for the troffer lighting fixture of FIG. 1.

FIG. 2B is a schematic diagram of a square lens 38 for the troffer lighting fixture 10 of FIG. 1. The square lens 38 may present a flat center region 40 disposed over the light engine 12 and flat sides 44 perpendicular to the center region 40. The square lens 38 further includes ends 42 which are shaped to attach to the housing 14 (e.g., with a tongue-and-groove, a fastener, or similar mechanical attachment).

Figure 2C:
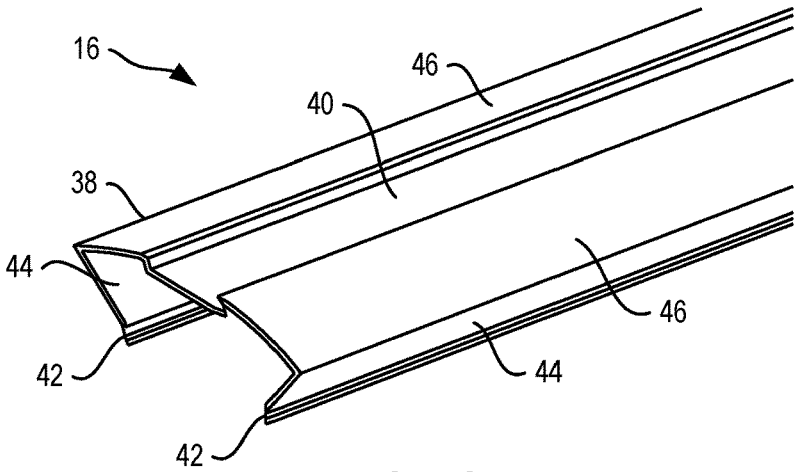
FIG. 2C is a schematic diagram of an architectural lens for the troffer lighting fixture of FIG. 1.

FIG. 2C is a schematic diagram of an architectural lens 38 for the troffer lighting fixture 10 of FIG. 1. The architectural lens 38 may present a flat or curved center region 40 disposed over the light engine 12 abutted by curved wings 46 elevated above the center region 40. The wings 46 may meet flat sides 44 at an oblique angle, terminating in ends 42 which are shaped to attach to the housing 14 (e.g., with a tongue-and-groove, a fastener, or similar mechanical attachment).

With continuing reference to FIGS. 2A-2C, the lens 38 may be formed as a single piece or with multiple connected pieces. The lens 38 can be constructed from various materials, including but not limited to acrylic (e.g., molded or extruded acrylic), plastic, and glass. In one example, the entire lens 38 is light transmissive and diffusive. In one example, one or more sections of the lens 38 are clear. The outer surfaces of the lens 38 may be uniform or may have different features and diffusion levels. In another example, one or more sections of the lens 38 is more diffuse than the remainder of the lens 38. In one example, the lens 38 has a constant thickness across its length and width. In other examples, the lens 38 has a variable thickness (e.g., across its length and/or width).

As described above, the lens assembly 16 according to embodiments described herein redirects light exiting the lighting fixture 10 such that the UGR is reduced. UGR is a method of calculating discomfort glare from luminaires in interior lighting. The UGR formula is given as follows (see, e.g., CIE 117-1995):

$$UGR = 8\log\left[\frac{0.25}{L_b}\sum\frac{L^2\omega}{p^2}\right]$$

where $L_b$ is the background luminance (measured in candelas per square meter (cd/m$^2$)), L is the luminance of the luminous parts of each luminaire (e.g., lighting fixture) in the direction of an observer (measured in cd/m$^2$), ω is the solid angle of the luminous parts of each luminaire at the observer (measured in steradians (sr)), and p is the Guth position index for each luminaire (e.g., displacement from the line of sight of the observer).

In other words, the UGR varies with output Lumens, light distribution, fixture dimension, and reflectance of the ceiling/wall/floor. The UGR scale has a practical range of 10 to 30 (unitless). The higher the number the more likely the luminaire will cause discomfort glare.

For illustrative purposes, the UGR is defined herein using a matrix for troffer lighting fixtures 10 at a room dimension X=4H, Y=8H, spacing to height (S/H): 1, and reflectance on ceiling/wall/floor=70/50/20%. The observer's height is 1.2 m, and observer position is at the midpoint of a side wall with horizontal line of sight towards the midpoint of the opposite wall. Endwise UGR is defined where an elongated dimension of the troffer lighting fixtures 10 is parallel to the line of sight and crosswise UGR is defined where the elongated dimension of the troffer lighting fixtures is perpendicular to the line of sight.

Under the above definition, each of the proposed embodiments achieves endwise and crosswise UGR which is below 22.

I. Lens Assembly with Prismatic Surface

FIG. 3A is a schematic diagram of a troffer lighting fixture 10 having a lens assembly 16 with a prismatic inner surface 48 for redirecting light according to a first aspect described herein. The lens assembly 16 include a lens 38 (which may be considered an outer lens) with the inner prismatic surface 48 to redirect light away from the housing 14 in order to improve (reduce) UGR when viewed endwise and/or crosswise. This may further result in a more symmetric distribution of light exiting the lighting fixture 10 via the lens 38.

FIG. 3B is a cross-sectional view of a curved lens 38 with a prismatic inner surface 48 for the troffer lighting fixture 10 of FIG. 3A. FIG. 3C is a cross-sectional view of a square lens 38 with a prismatic inner surface 48 for the troffer lighting fixture 10 of FIG. 3A. FIG. 3D is a cross-sectional view of an architectural lens 38 with a prismatic inner surface 48 for the troffer lighting fixture 10 of FIG. 3A.

In each of the illustrated embodiments, the lens 38 is defined by an outer surface 50 which is visible when the lighting fixture 10 is installed, and the prismatic inner surface 48. In some embodiments, the outer surface 50 is optically translucent, partially transparent, or otherwise reflect, refract, scatter, or diffract light such that the prismatic inner surface 48 and/or the LED elements 34 are not visible. In other embodiments, the outer surface 50 is optically transparent such that the prismatic inner surface 48 is visible.

The prismatic inner surface 48 may include or be defined by an array of prismatic facets 52 which facilitate redirection of light. The prismatic facets 52 may have a triangular shape extending away from the outer surface 50. The triangular shape of the prismatic facets 52 may further be rounded at peaks and/or troughs. In some embodiments, the prismatic facets 52 are defined by grooves in the prismatic inner surface 48, which may extend along an elongated dimension of the lens 38. In some embodiments, the prismatic facets 52 may not extend along the elongated dimension but may instead be tiled or otherwise textured across the prismatic inner surface 48. The prismatic facets 52 may be formed by an appropriate technique, such as molding (e.g., injection or other molding), extrusion, additive or subtractive processes.

Figure 4B:
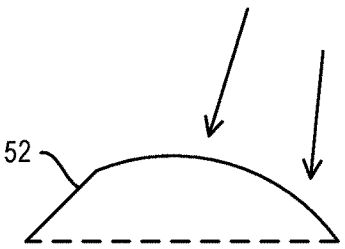
FIG. 4B is a schematic diagram of another exemplary prismatic facet.
Figure 4A:
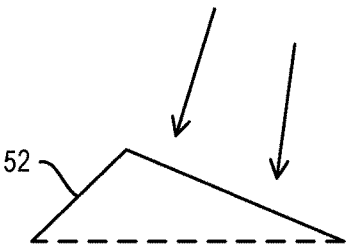
FIG. 4A is a schematic diagram of an exemplary prismatic facet on the prismatic surface of the lens of FIGS. 3A-3D.

FIG. 4A is a schematic diagram of an exemplary prismatic facet 52 on the prismatic surface 48 of the lens 38 of FIGS. 3A-3D. In some embodiments, the prismatic facet 52 has a triangular shape defined by straight sides as illustrated. FIG. 4B is a schematic diagram of another exemplary prismatic facet 52. In some embodiments, the prismatic facets 52 have a triangular shape with one or more curved sides as illustrated. Some embodiments may use combinations of shapes illustrated in FIGS. 4A-4C.

Figure 4C:
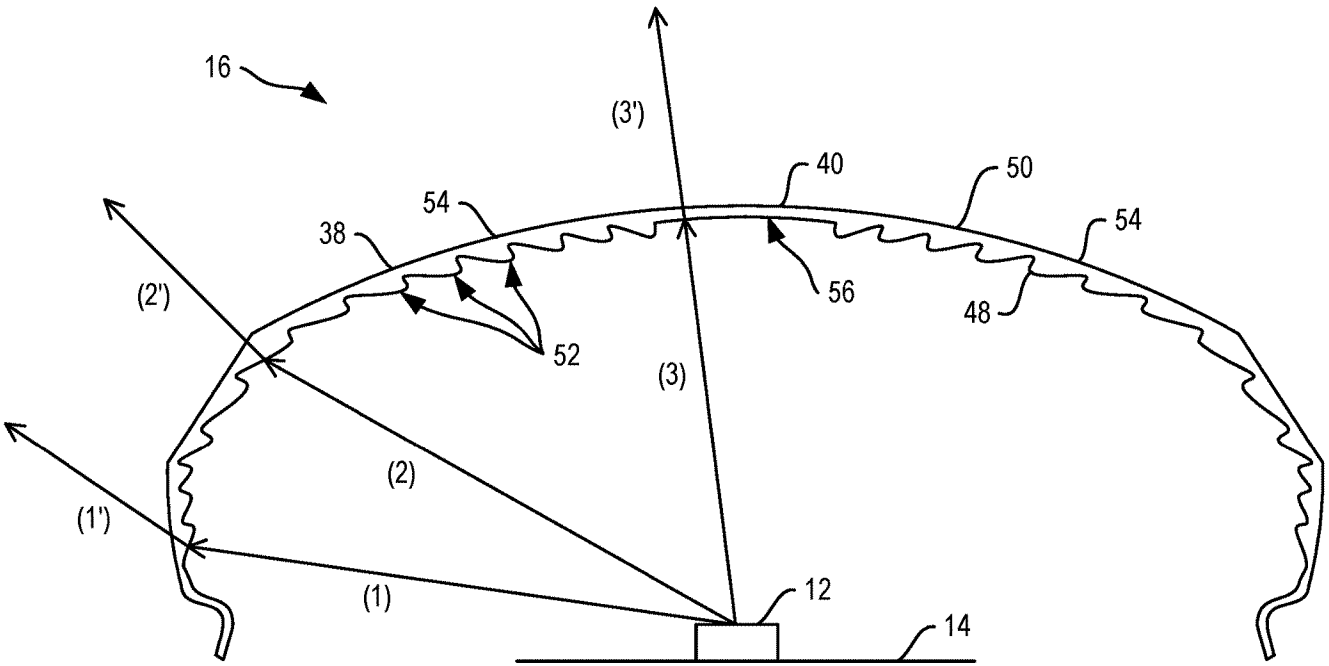
FIG. 4C is a schematic diagram illustrating the lens assembly according to FIGS. 3A-3D redirecting light away from the housing.

More particularly, as will be shown in FIG. 4C, the prismatic facets 52 redirect light emitted from sides of the light engine 12 (e.g., toward side regions 54 or sections of the lens 38) in a more downward direction than emitted from a center of the light engine 12 (e.g., toward the center region 40 or section of the lens 38) when the lighting fixture 10 is installed in a ceiling. In this regard, the center region 40 of the lens 38 may further have a non-prismatic inner surface 56 while the side regions 54 have the prismatic inner surface 48. As such the center region 40 may have a constant first thickness and the side regions 54 may vary between a second thickness and a third thickness. In some examples, the first thickness of the middle region 40 is between the second thickness and the third thickness of the side regions 54, though it may be greater than or less than both.

FIG. 4C is a schematic diagram illustrating the lens assembly 16 according to FIGS. 3A-3D redirecting light away from the housing 14. Light rays emitted from the light engine 12 (e.g., from the LEDs) are gradually redirected by the prismatic facets 52 of the lens 38 to a more forward direction (e.g., illustrated as upward, but would be a downward direction when the lighting fixture 10 is installed in a ceiling) so that UGR can be improved. For example, light ray (1) is refracted into ray (1') further than ray (2') is refracted from ray (2), which is also further than ray (3') is refracted from ray (3). In some embodiments, the center region 40 has a non-prismatic inner surface 56 which does not refract ray (3).

In some embodiments, the lens 38 may further have a scattering material (e.g., a volumetric scattering material) diffused through its thickness to further improve the distribution of light exiting the lens 38. In some embodiments, the lens 38 may have surface scattering features (or surface diffusing features, not volume scattering in this case) on only the outer surface while the lens material is clear (or highly transparent). Such a scattering feature may be prismatic and may be more efficient for the light redirection.

Figure 5B:
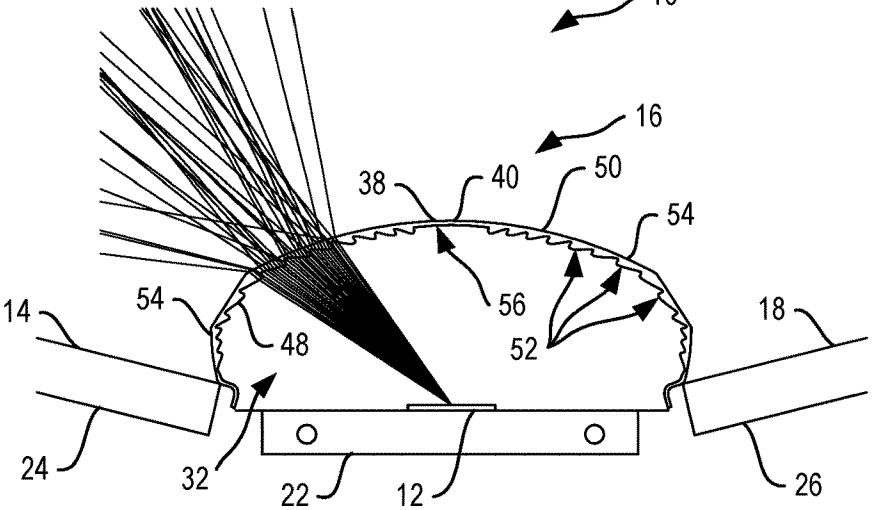
FIG. 5B is a schematic diagram of the lighting fixture of FIG. 3A illustrating a ray fan with the lens assembly having a prismatic inner surface and a diffusive lens material.
Figure 5A:
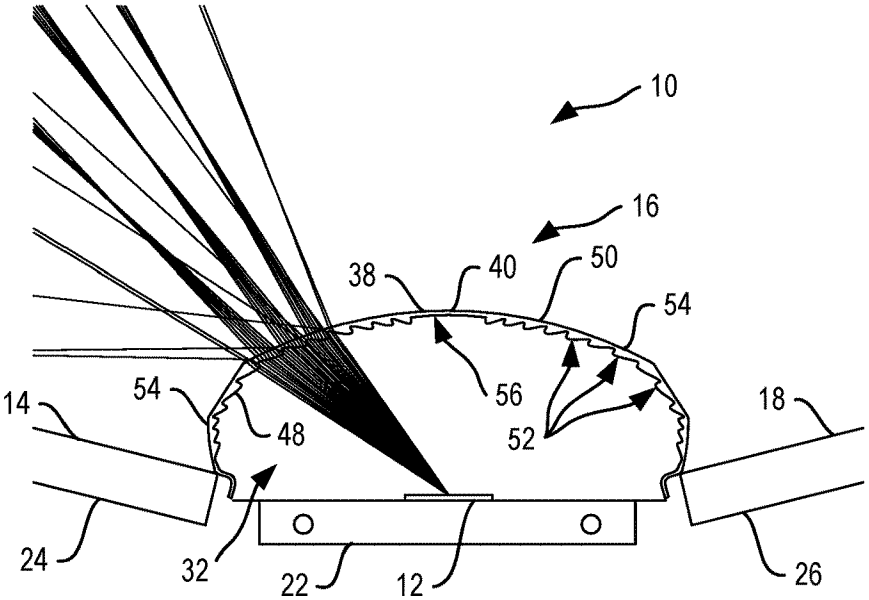
FIG. 5A is a schematic diagram of the lighting fixture of FIG. 3A illustrating a ray fan with the lens assembly having a prismatic inner surface and a transparent lens material.

FIG. 5A is a schematic diagram of the lighting fixture 10 of FIG. 3A illustrating a ray fan with the lens assembly 16 having a prismatic inner surface 48 and a transparent lens material. FIG. 5B is a schematic diagram of the lighting fixture 10 of FIG. 3A illustrating a ray fan with the lens assembly 16 having a prismatic inner surface 48 and a diffusive lens material. As illustrated in FIGS. 5A and 5B, the addition of a diffusive lens material (e.g., scattering material) can result in a more equal light distribution pattern than the prismatic inner surface 48 alone. In some embodiments, the entire lens 38 includes the diffusive material. In other embodiments, portions of the lens 38 (such as the center region 40) may not have the diffusive material or may have different diffusion levels. In some embodiments, such scattering or diffusion may also be accomplished with a transparent lens material. For example, the outer surface 50 of the lens 38 may have surface scattering features.

Figure 6A:
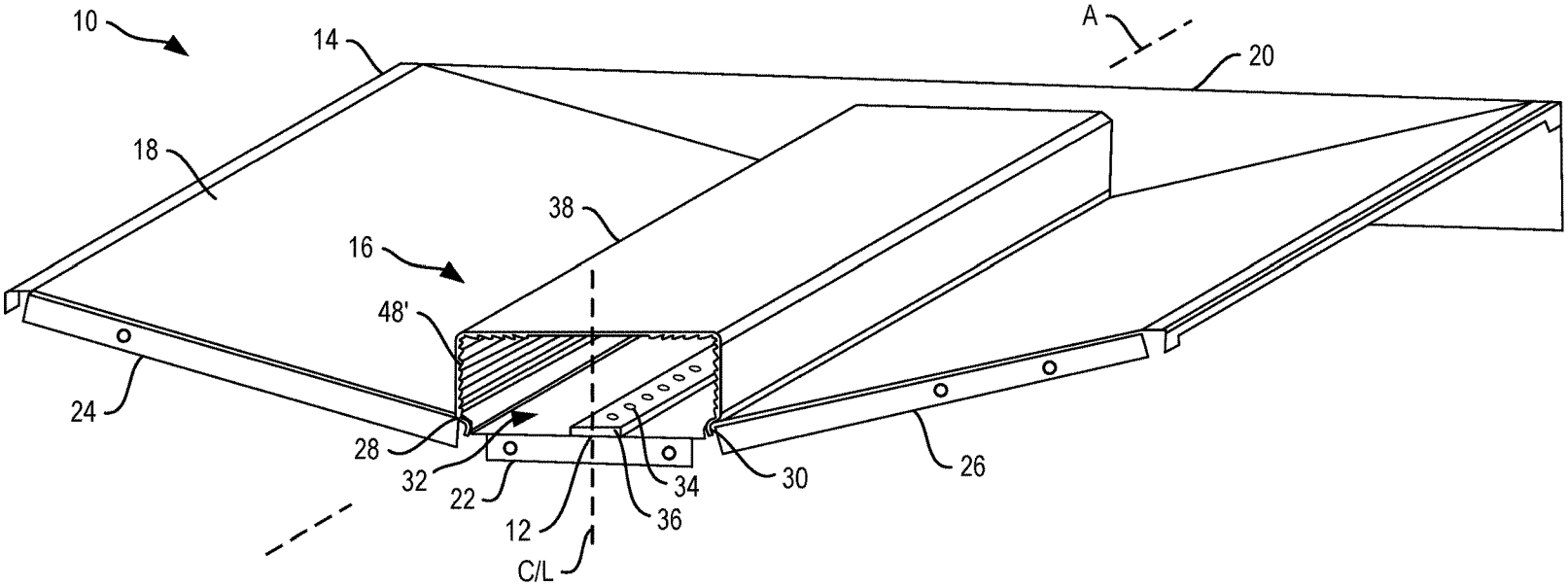
FIG. 6A is a schematic diagram of a troffer lighting fixture having a lens assembly with a modified prismatic inner surface having prismatic features in a reduced zone.

FIG. 6A is a schematic diagram of a troffer lighting fixture 10 having a lens assembly 16 with a modified prismatic inner surface 48' having prismatic features in a reduced zone. The modified prismatic inner surface 48' is defined by a larger center region 40 without prismatic features. In one embodiment, the center region 40 has a thickness of 2.0 mm (e.g., between 1.9 and 2.1 mm), while the side regions 54 have a thickness which varies between 1.0 mm and 3.5 mm. The modified prismatic inner surface 48' with its larger center region 40 may further improve UGR and/or efficiency of the lighting fixture 10.

Figure 6C:
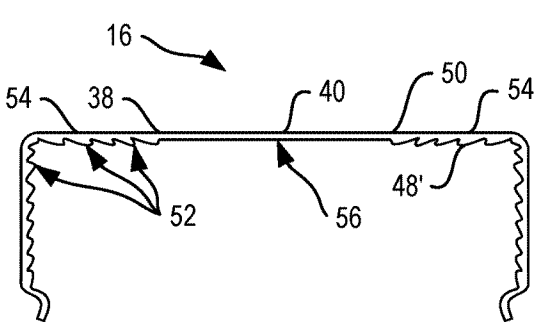
FIG. 6C is a cross-sectional view of a square lens with the modified prismatic inner surface for the troffer lighting fixture of FIG. 6A.
Figure 6D:
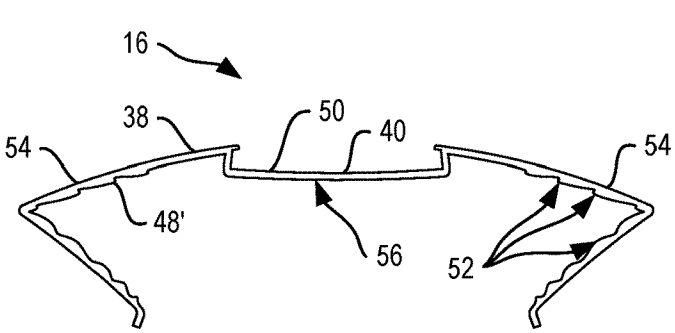
FIG. 6D is a cross-sectional view of an architectural lens with the modified prismatic inner surface for the troffer lighting fixture of FIG. 6A.
Figure 6B:
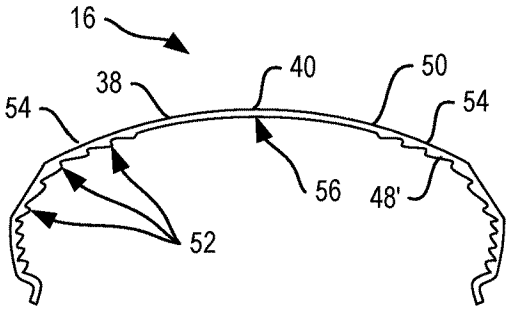
FIG. 6B is a cross-sectional view of a curved lens with the modified prismatic inner surface for the troffer lighting fixture of FIG. 6A.

FIG. 6B is a cross-sectional view of a curved lens 38 with the modified prismatic inner surface 48' for the troffer lighting fixture 10 of FIG. 6A. FIG. 6C is a cross-sectional view of a square lens 38 with the modified prismatic inner surface 48' for the troffer lighting fixture 10 of FIG. 6A. FIG. 6D is a cross-sectional view of an architectural lens 38 with the modified prismatic inner surface 48' for the troffer lighting fixture 10 of FIG. 6A.

Figure 6E:
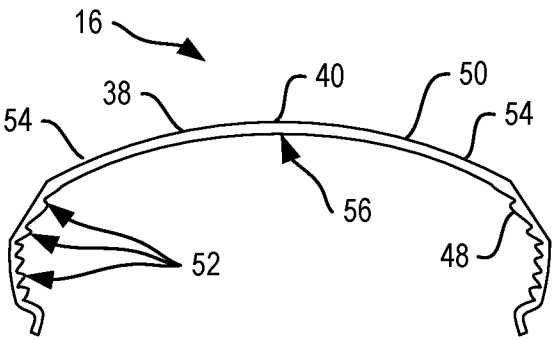
FIG. 6E is a cross-sectional view of a curved lens with the prismatic inner surface having prismatic facets on sides of the lens and not on a curved center region over the light engine for the troffer lighting fixture of FIG. 6A.
Figure 6G:
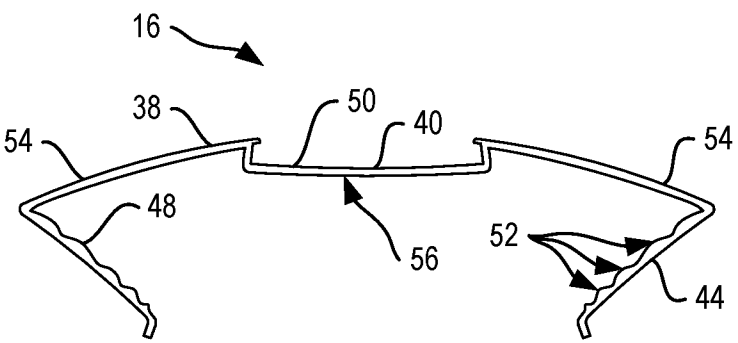
FIG. 6G is a cross-sectional view of an architectural lens with the prismatic inner surface having prismatic facets on flat sides of the lens and not on the center region for the troffer lighting fixture of FIG. 6A.
Figure 6F:
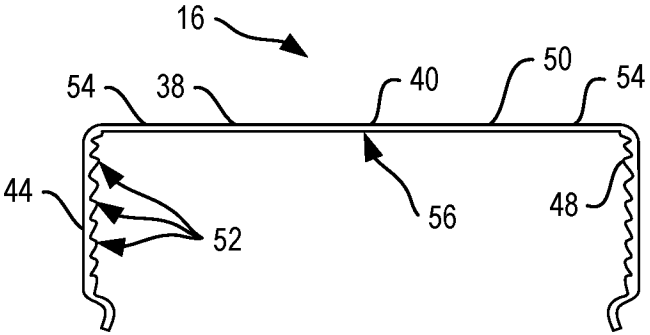
FIG. 6F is a cross-sectional view of a square lens with the prismatic inner surface having prismatic facets on flat sides of the lens and not on the center region for the troffer lighting fixture of FIG. 6A.

As illustrated in FIGS. 6E-6G, in some embodiments the zone of prismatic features on the prismatic inner surface 48 can be further decreased. FIG. 6E is a cross-sectional view of a curved lens 38 with the prismatic inner surface 48 having prismatic facets 52 on sides of the lens 38 and not on a curved center region 40 over the light engine 12 (e.g., where the sides are defined by angled surfaces adjoining the curved center region 40). FIG. 6F is a cross-sectional view of a square lens 38 with the prismatic inner surface 48 having prismatic facets 52 on the flat sides 44 of the lens 38 and not on the center region 40. FIG. 6G is a cross-sectional view of an architectural lens 38 with the prismatic inner surface 48 having prismatic facets 52 on the flat sides 44 of the lens 38 and not on the center region 40.

II. Lens Assembly with Inner Lens

Figure 7A:
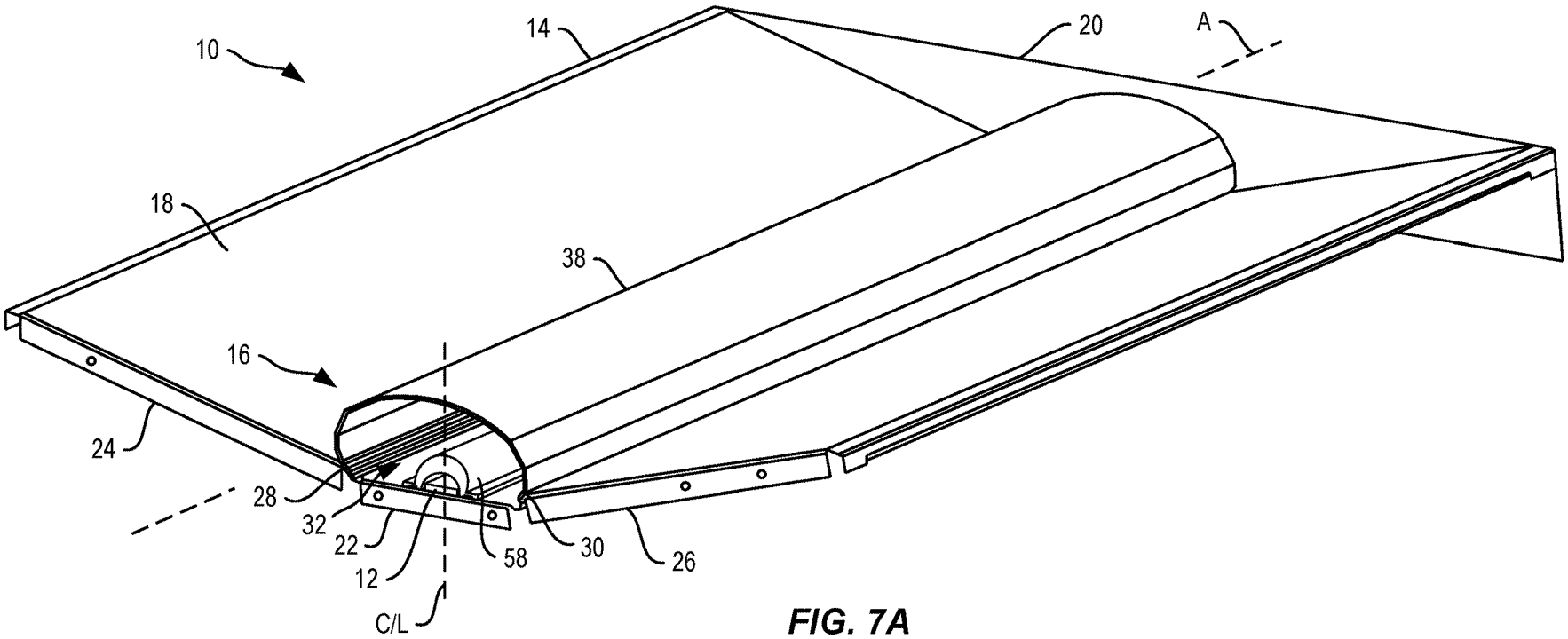
FIG. 7A is a schematic diagram of a troffer lighting fixture having a lens assembly with an outer lens along with an inner lens for redirecting light according to a second aspect described herein.

FIG. 7A is a schematic diagram of a troffer lighting fixture 10 having a lens assembly 16 with an outer lens 38 along with an inner lens 58 for redirecting light according to a second aspect described herein. The inner lens 58 is positioned in the interior space 32 and over the light engine 12. In some embodiments, the inner lens 58 is attached to the light engine 12 (e.g., directly or indirectly). In other embodiments, the inner lens 58 is attached to the back pan 18 or another portion of the housing 14. In one example, the inner lens 58 extends the entirety of the back pan 18. In another example, the inner lens 58 is positioned inward from one or both ends of the back pan 18.

Figure 7B:
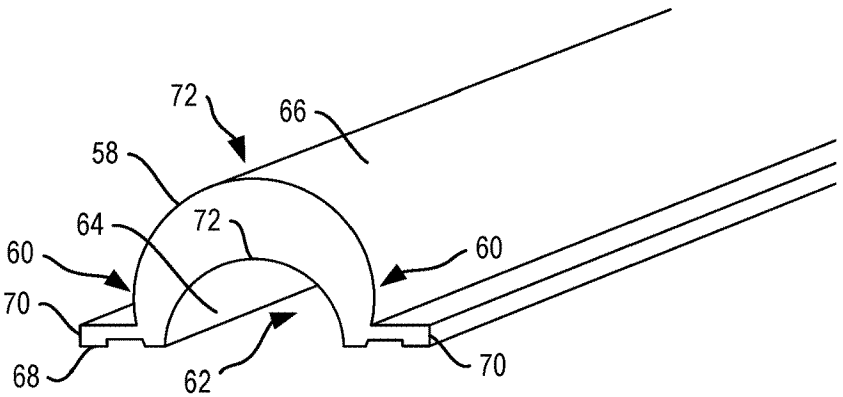
FIG. 7B is a schematic diagram of the inner lens for redirecting light of FIG. 7A.

FIG. 7B is a schematic diagram of the inner lens 58 for redirecting light of FIG. 7A. As will be further illustrated in FIG. 8, the inner lens 58 redirects light entering at sides 60 of the inner lens 58 toward a center of the outer lens 38 to reduce the UGR of the lighting fixture 10 when viewed endwise and/or crosswise. The inner lens 58 generally includes a cavity 62 that extends the length of the inner lens 58 and is positioned over the light engine 12. The cavity 62 defines an inner curved surface 64 facing the back pan 18. The inner lens 58 also includes an outer curved surface 66 spaced on the opposing surface away from the cavity 62 and inner curved surface 64.

The inner lens 58 includes an elongated shape along a first axis to extend along the back pan 18. A distance between the inner curved surface 64 and the outer curved surface 66 is larger at a center 72 over the light engine 12 than at the sides 60. For example, each of the inner curved surface 64 and the outer curved surface 66 is cylindrical (e.g., defining at least a portion of a cylinder, such as a half cylinder). The inner curved surface 64 may be defined by a first radius and a first cylindrical axis and the outer curved surface 66 may be defined by a second radius and a second cylindrical axis. As illustrated in FIG. 7B, the second radius may be larger than the first radius, and the second cylindrical axis may be offset from (e.g., above) the first cylindrical axis.

In some embodiments, the inner lens 58 may further include a flange 70 on one or both sides of the outer curved surface 66. A bottom edge 68 extends along the bottom of the inner lens 58, which may be defined along the flanges 70. The bottom edge 68 can include various shapes that can be flat or uneven (e.g., notched, as illustrated in FIG. 7B).

Generally, the inner lens 58 is optically transparent. In some embodiments, the inner lens 58 is not visible when the outer lens 38 is coupled to the lighting fixture 10 (e.g., because the outer lens 38 is diffusive or scattering, rather than transparent).

Figure 8:
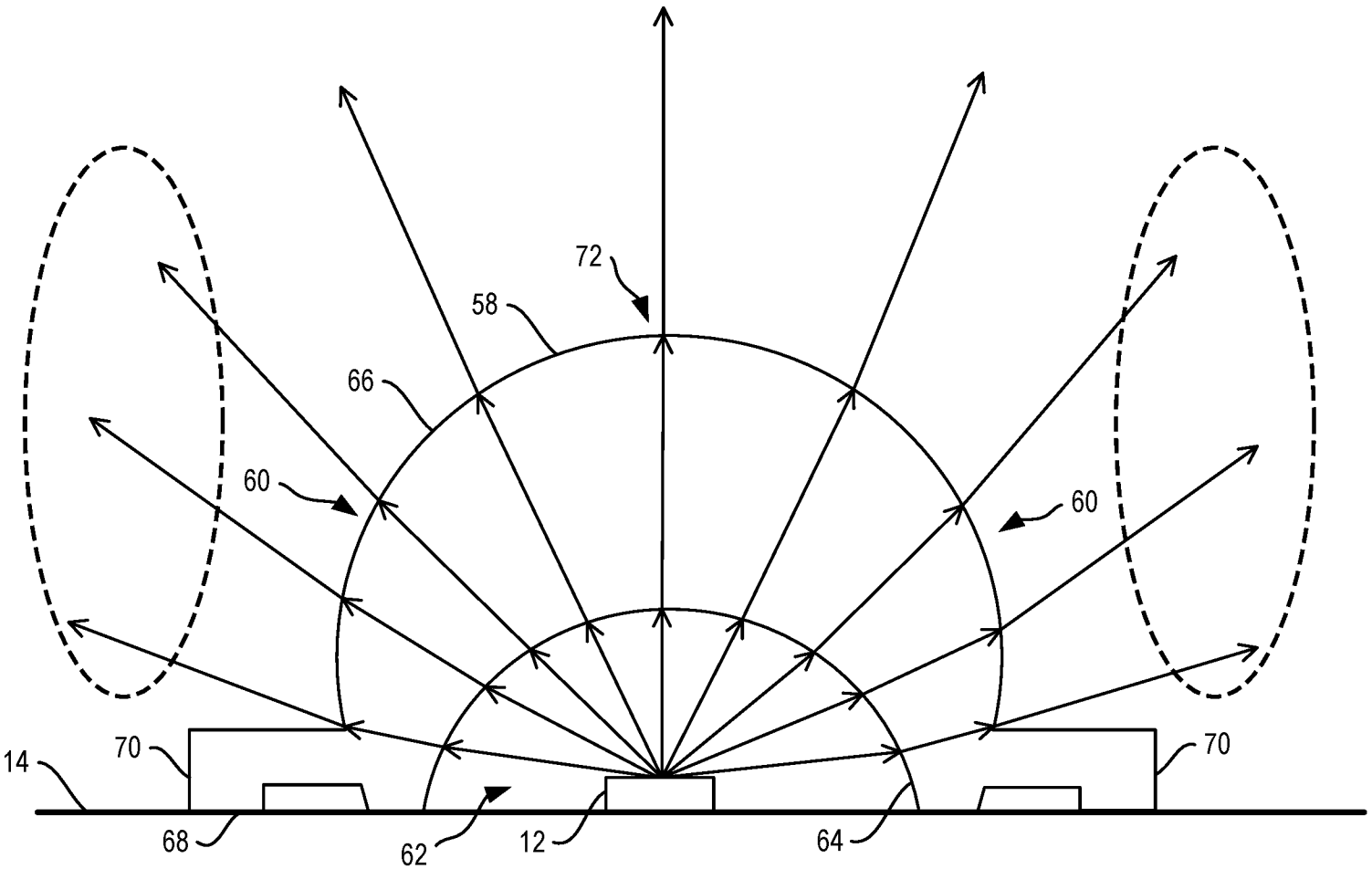
FIG. 8 is a schematic diagram illustrating the inner lens according to FIGS. 7A and 7B redirecting light away from the housing.

FIG. 8 is a schematic diagram illustrating the inner lens 58 according to FIGS. 7A and 7B redirecting light away from the housing 14. In this regard, the inner lens 58 redirects light from the light engine 12 with a larger v-angle at the sides 60 of the inner lens 58 compared with the center 72 of the inner lens 58. The inner lens 58 is a positive meniscus lens that redirects light in a more forward direction (e.g., away from the housing 14 and toward the center 72) at the sides 60. The light rays may be redirected gradually about the radius of the inner lens 58.

In this regard, the light rays are refracted on the curved inner surface 64 of the cavity 62 and then pass through the inner lens 58 and are further refracted at the curved outer surface 66 as they exit the inner lens 58. In general, the inner lens 58 transfers the light rays inward in narrower angles without overlap. This enables the light to have a smooth distribution without shadows or hotspots after exiting the lighting fixture 10. The inner lens 58 is shaped with the lens thickness gradually and symmetrically increasing from the sides 60 to the center 72 (e.g., at a peak of the cavity 62). The curved inner surface 64 and curved outer surface 66 have slowly varying curvatures so that light can be uniformly distributed on the whole target area or surface. The slowly varying curvature may diminish shadows or hot spots which may be generated on the lenses 38, 58.

In one example, the inner lens 58 has little or no total internal reflection portions on the whole curved outer surface 66. Instead, light rays are refracted smoothly and sequentially without shadows or hot spots. The curved inner surface 64 is generally smooth for light coupling so that light rays are refracted towards the inside of the inner lens 58 in narrow angles to help in shaping the narrow light distribution. The slowly varying surface enables smooth and sequential light refraction and narrow distribution without interactions among light rays to form uniform luminance in the target area. In some embodiments, the inner lens 58 is symmetrical about the center 72.

Figure 9B:
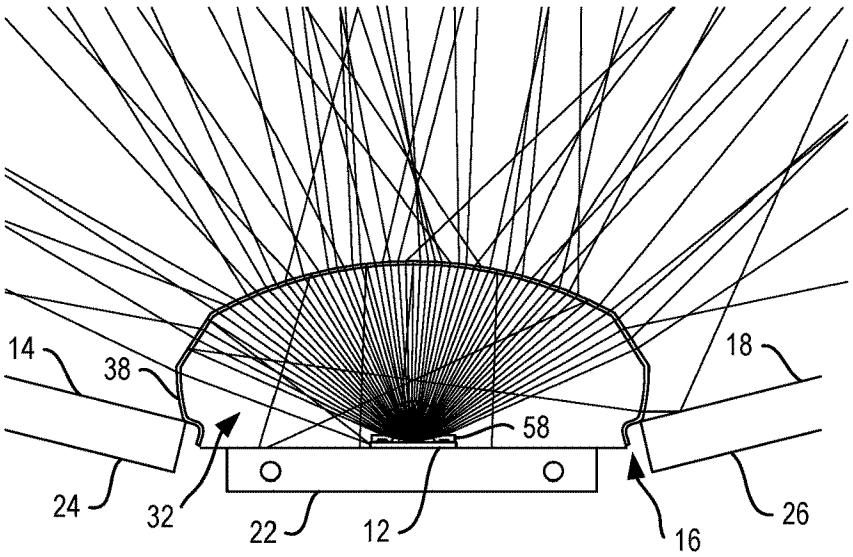
FIG. 9B is a schematic diagram of the troffer lighting fixture of FIG. 7A illustrating a ray fan.
Figure 9A:
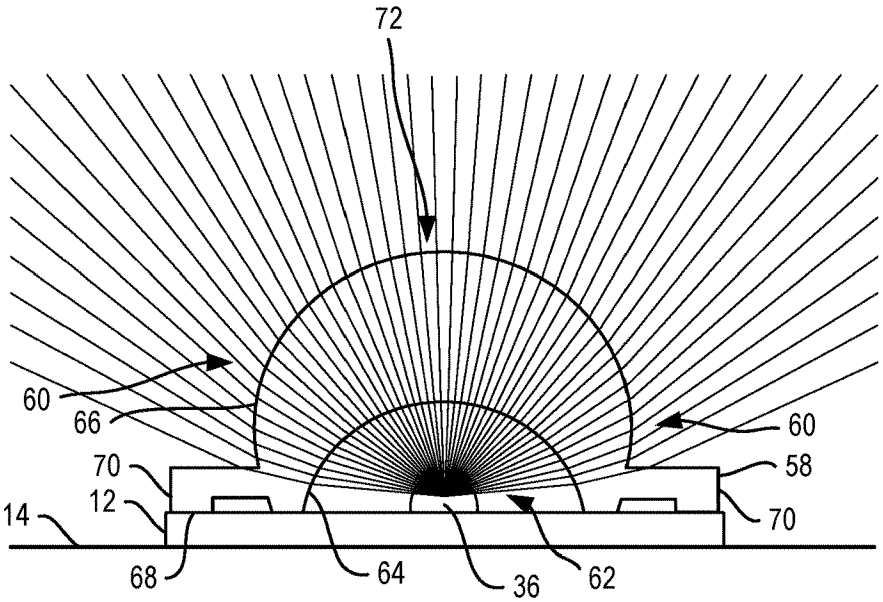
FIG. 9A is a schematic diagram of the inner lens of FIGS. 7A and 7B illustrating a ray fan.

FIG. 9A is a schematic diagram of the inner lens 58 of FIGS. 7A and 7B illustrating a ray fan. The inner lens 58 smoothly and gradually distributes the light rays toward the center 72 (e.g., away from the housing 14). The light rays are thus directed in an upward direction relative to the figure (which corresponds to a downward direction when the lighting fixture 10 is mounted in a ceiling). In some embodiments, at the center 72 of the inner lens 58 the light rays may not be refracted or may be only slightly refracted while light rays at the sides 60 are refracted at greater v-angles. This may result in a narrower distribution of light than a lighting fixture 10 without the inner lens 58. The ray fan illustrates that the light rays are distributed uniformly and gradually, which minimizes shadows when the lighting fixture 10 is viewed from a side.

FIG. 9B is a schematic diagram of the lighting fixture 10 of FIG. 7A illustrating a ray fan. As illustrated, some of the light rays exiting the inner lens 58 may be reflected or refracted by the outer lens 38, but the lens assembly 16 maintains a gradual and uniform redirection of light away from the housing 14 (shown as upward in the figure) with reduced shadows. A majority of the light is distributed upward from the lens assembly 16 without reflecting from the housing 14. Some portion of the light is reflected from the housing 14 (e.g., where the outer lens 38 reflects the light). The light from the inner lens 58 forms a wide luminance pattern that substantially fills the outer lens 38.

The lighting fixture 10 generally includes a single inner lens 58. The inner lens 58 can include various design features. In the various examples, the inner lens 58 is designed to redirect light from the light engine 12 away from the housing 14 and reduce UGR of the lighting fixture 10. The inner lens 58 can be constructed from a variety of materials, including but not limited to acrylic, transparent plastics, and glass. FIGS. 10A-12B illustrate different examples of an inner lens 58 that can be used in the lighting fixture 10. Each includes different aspects that may affect the light distribution, performance, and/or manufacturing of the inner lens 58.

Figure 10A:
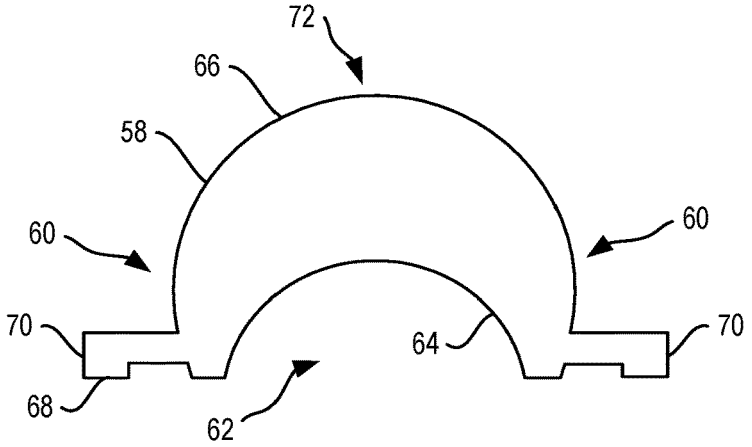
FIG. 10A is a cross-sectional view of an exemplary inner lens having a flange.
Figure 10B:
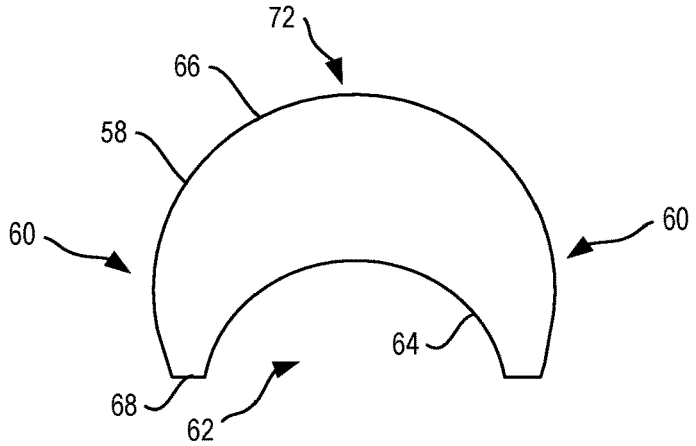
FIG. 10B is a cross-sectional view of another exemplary inner lens without the flange.

FIG. 10A is a cross-sectional view of an exemplary inner lens 58 having the flange 70. FIG. 10B is a cross-sectional view of another exemplary inner lens 58 without the flange 70.

Figure 10C:
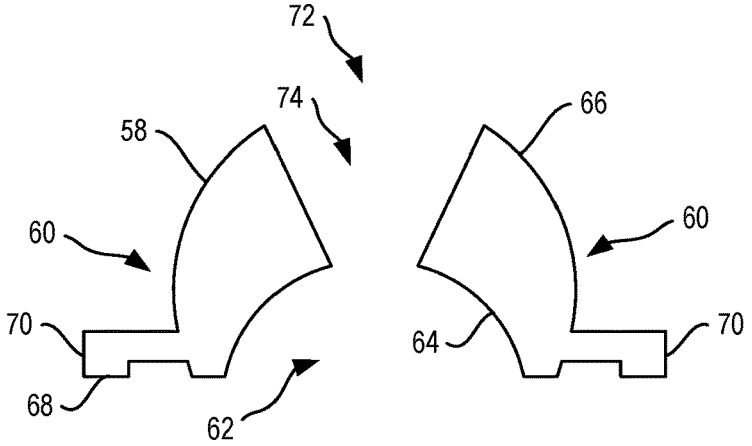
FIG. 10C is a cross-sectional view of another exemplary inner lens with an open mid-section.

FIG. 10C is a cross-sectional view of another exemplary inner lens 58 with an open mid-section 74. In this regard, the mid-section 74 may include an opening extending along the center 72 of the inner lens 58. In some embodiments, the inner lens 58 with the open mid-section 74 may be formed as two separate pieces. In other embodiments, the inner lens 58 may be formed as a single piece (e.g., with ends along the elongated direction being connected, or with additional connections between the sides 60). In some embodiments, the opening in the mid-section 74 spans a 50° angle from the axis of the curved inner surface 64 and/or curved outer surface 66. In other embodiments, the opening spans an angle between 45° and 55° or between 40° and 60°.

Figure 11A:
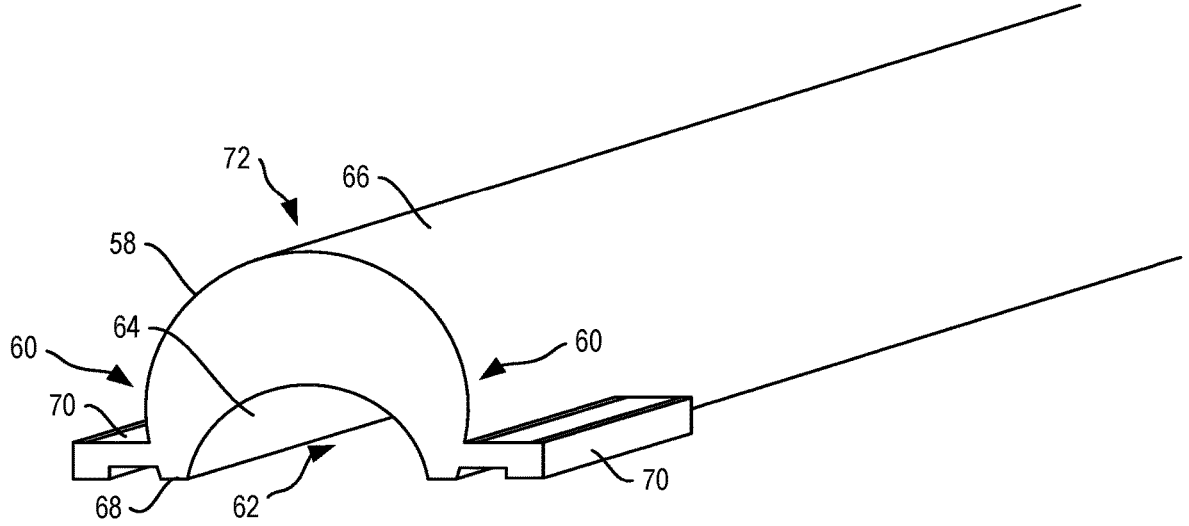
FIG. 11A is a schematic diagram of an exemplary inner lens having a partial flange.
Figure 11B:
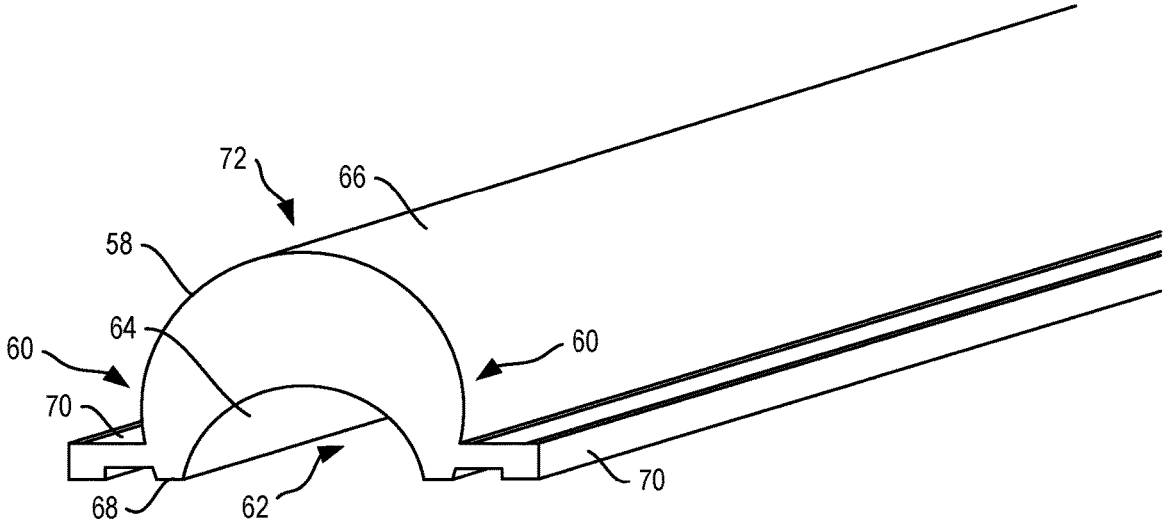
FIG. 11B is a schematic diagram of another exemplary inner lens having a flange extending its length.

FIG. 11A is a schematic diagram of an exemplary inner lens 58 having a partial flange 70. The illustrated inner lens 58 may be formed by an injection molding process. FIG. 11B is a schematic diagram of another exemplary inner lens 58 having a flange 70 extending its length. The illustrated inner lens 58 may be formed by an extrusion process.

Figure 12A:
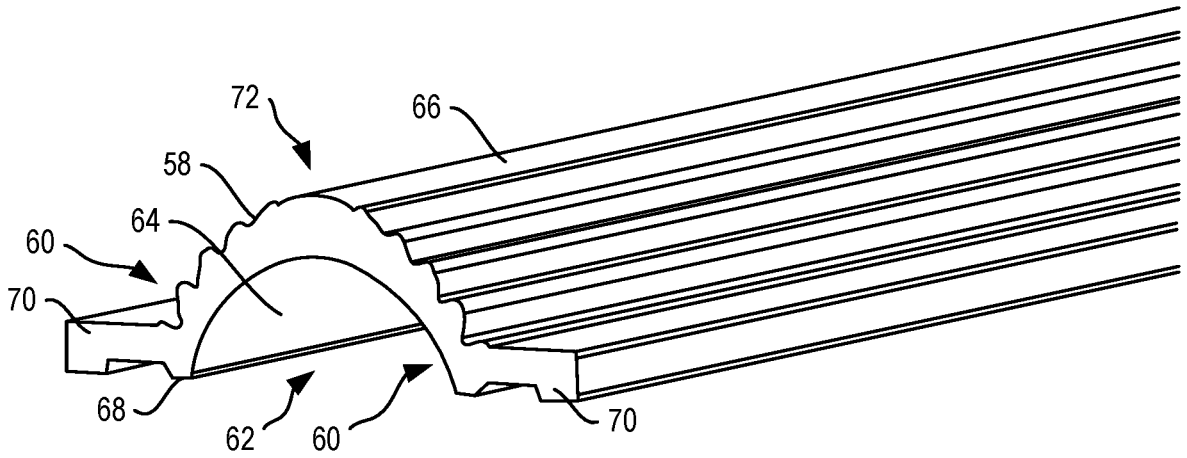
FIG. 12A is a schematic diagram of an exemplary Fresnel inner lens.
Figure 12B:
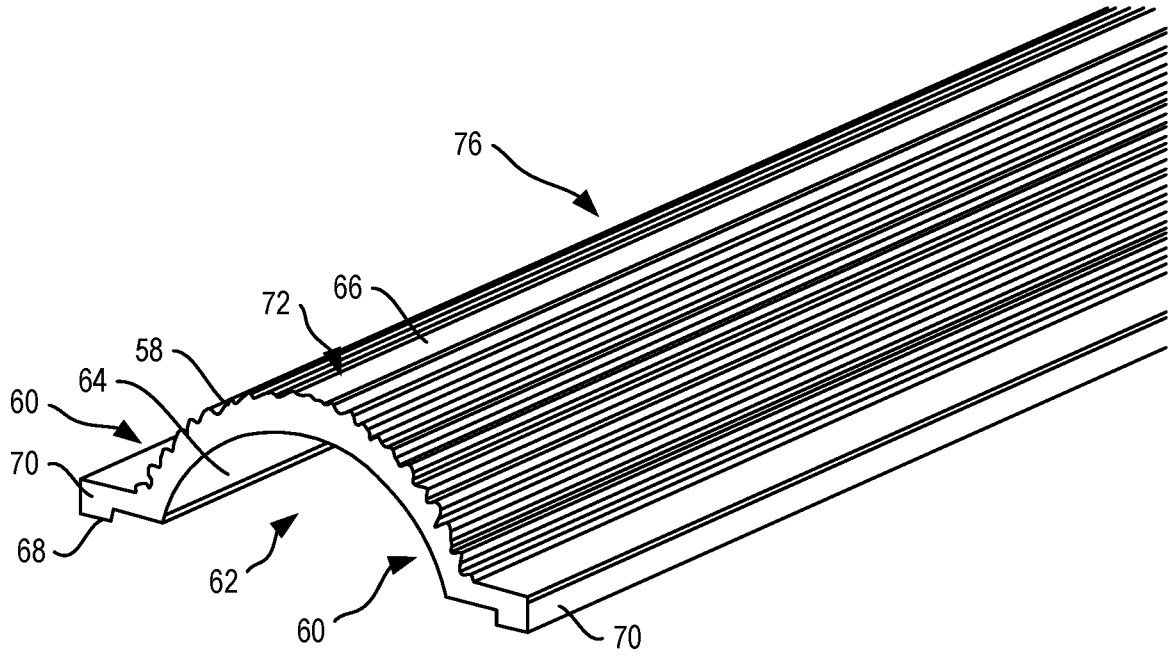
FIG. 12B is a schematic diagram of an exemplary larger Fresnel inner lens.

FIG. 12A is a schematic diagram of an exemplary Fresnel inner lens 58. FIG. 12B is a schematic diagram of an exemplary larger Fresnel inner lens 58. The Fresnel inner lens 58 may reduce a thickness of the inner lens 58 while maintaining its performance. In this regard, the Fresnel inner lens 58 may have a smooth curved inner surface 64 and a curved outer surface 66 with prismatic features 76 that divide the inner lens 58 into a set of concentric annular sections.

III. Lens Assembly with Louvers

Figure 13A:
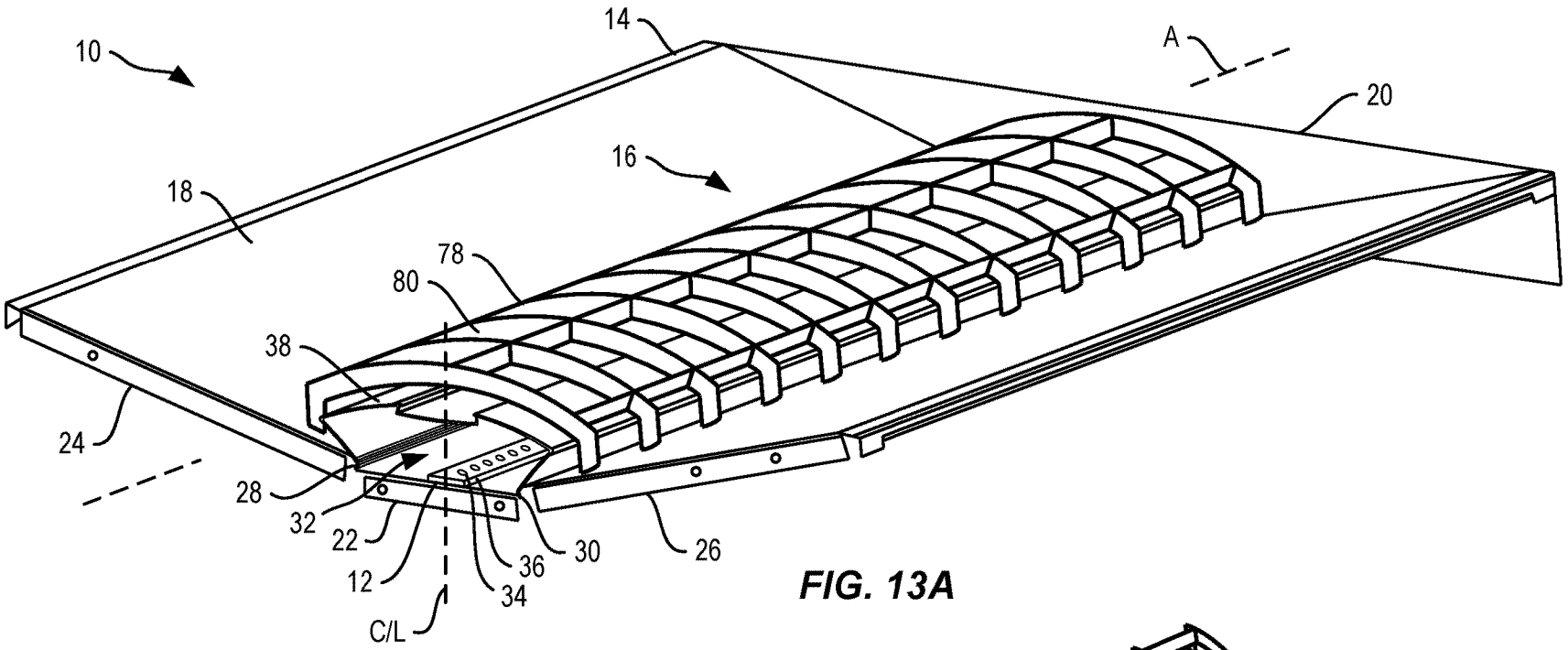
FIG. 13A is a schematic diagram of a troffer lighting fixture having a lens assembly with a lens and a louver assembly for redirecting light according to a third aspect described herein.

FIG. 13A is a schematic diagram of a troffer lighting fixture 10 having a lens assembly 16 with a lens 38 and a louver assembly 78 for redirecting light according to a third aspect described herein. The louver assembly 78 may be shaped to accommodate the lens 38 and may be formed from a grid of angled slats 80. The angle of the angled slats 80 may be selected to reflect, refract, or otherwise redirect light exiting sides of the lens 38 toward a center over the light engine 12. This may further reduce the UGR of the lighting fixture 10 when viewed endwise and/or crosswise. In some embodiments, the louver assembly 78 may have a reflective outer surface (e.g., a specular or otherwise reflective surface) or an opaque outer surface. In other embodiments, the louver assembly 78 is formed from a translucent material.

Figure 13B:
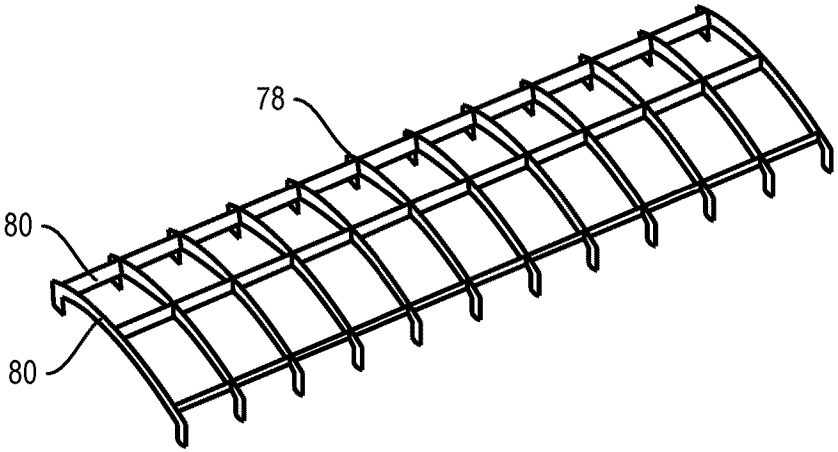
FIG. 13B is a schematic diagram of the louver assembly of FIG. 13A.

FIG. 13B is a schematic diagram of the louver assembly 78 of FIG. 13A. In the illustrated embodiment, the louver assembly 78 has a 12×3 grid of angled slats 80, which may be disposed over the lens 38 (e.g., directly coupled to the lens 38 or separately attached to the housing 14). Other embodiments may include a more or less dense grid of angled slats 80 according to desired performance.

Figure 14:
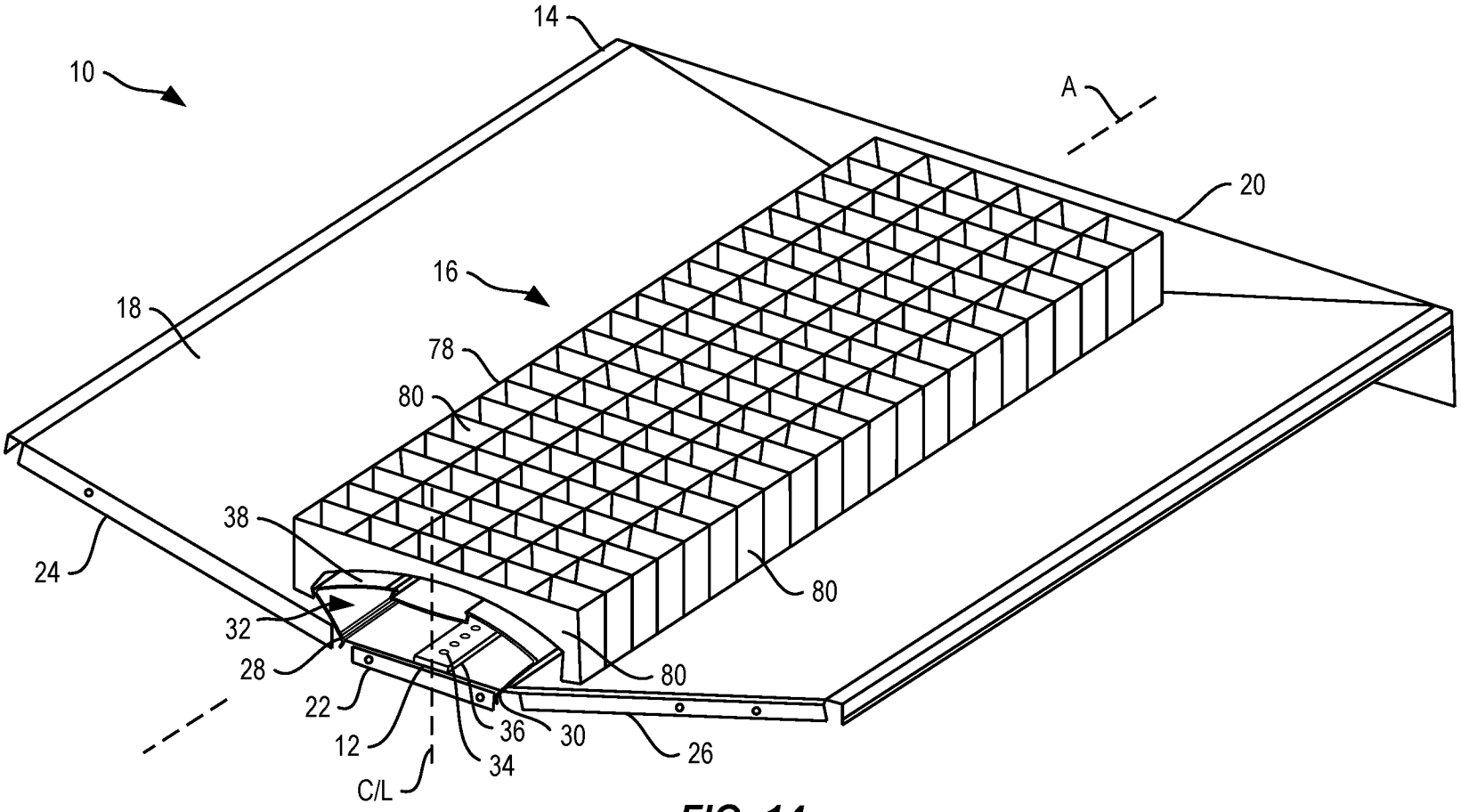
FIG. 14 is a schematic diagram of another troffer lighting fixture having a modified louver assembly for redirecting light.

FIG. 14 is a schematic diagram of another troffer lighting fixture 10 having a modified louver assembly 78 for redirecting light. Rather than conforming to the lens 38, the modified louver assembly 78 may have a bottom which is shaped to accommodate the lens 38 and a planar top. In the illustrated embodiment, the louver assembly 78 has a 23×7 grid of angled slats 80 which are angled perpendicular to a plane defined by the major surface of the center section 22 of the back pan 18.

Figure 15A:
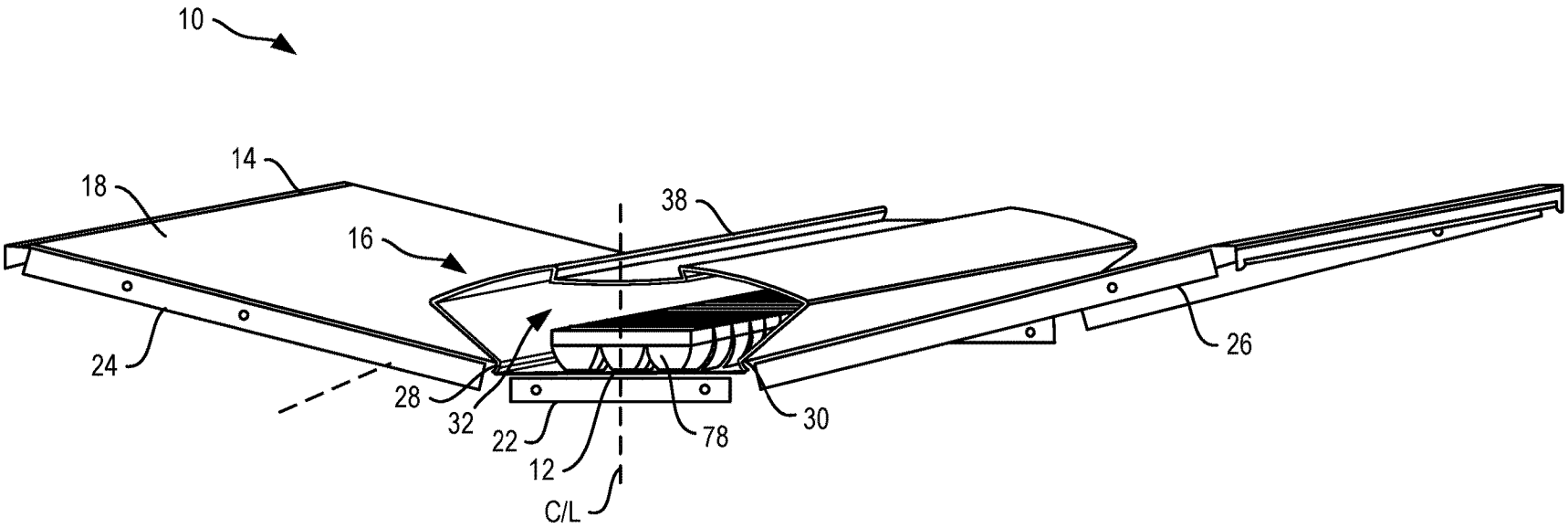
FIG. 15A is a schematic diagram of another troffer lighting fixture having an inner louver assembly for redirecting light.

FIG. 15A is a schematic diagram of another troffer lighting fixture 10 having an inner louver assembly 78 for redirecting light. The inner louver assembly 78 may be disposed between the lens 38 and the light engine 12 (e.g., in the interior space 32 and over the light engine 12). In some embodiments, the inner louver assembly 78 is directly attached to the light engine 12. In other embodiments, the inner louver assembly 78 is directly or indirectly attached to the back pan 18 of the housing 14.

Figure 15B:
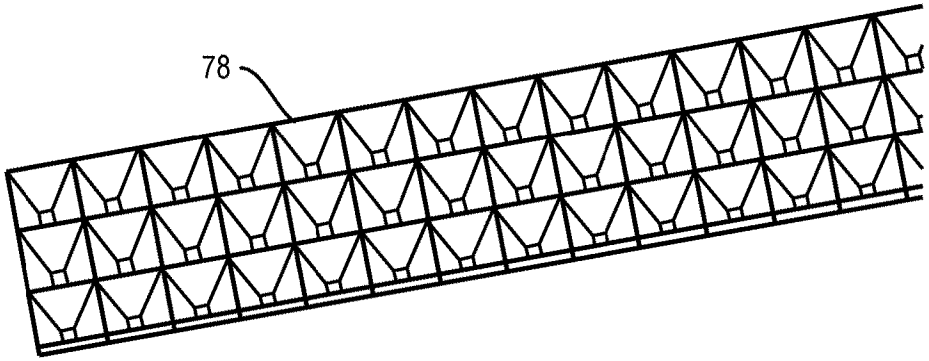
FIG. 15B is a schematic diagram of the inner louver assembly of FIG. 15A.

FIG. 15B is a schematic diagram of the inner louver assembly 78 of FIG. 15A. In the illustrated embodiment, the inner louver assembly 78 is a parabolic louver array with three rows of openings. In addition, LEDs are arrayed in five rows on a wide PCB and the inner louver assembly 78 is disposed over the middle three rows (such that individual LEDs are in individual parabolic openings of the inner louver assembly 78). The other two rows of LEDs are located outside the inner louver assembly 78 but inside the lens 38, enabling uniform luminance distribution while redirecting a majority of light upward. It should be noted that the height of the inner louver assembly 78 may be adjusted to reduce shadows at the sides of the lens 38.

IV. Lens Assembly with Reflector

Figure 16A:
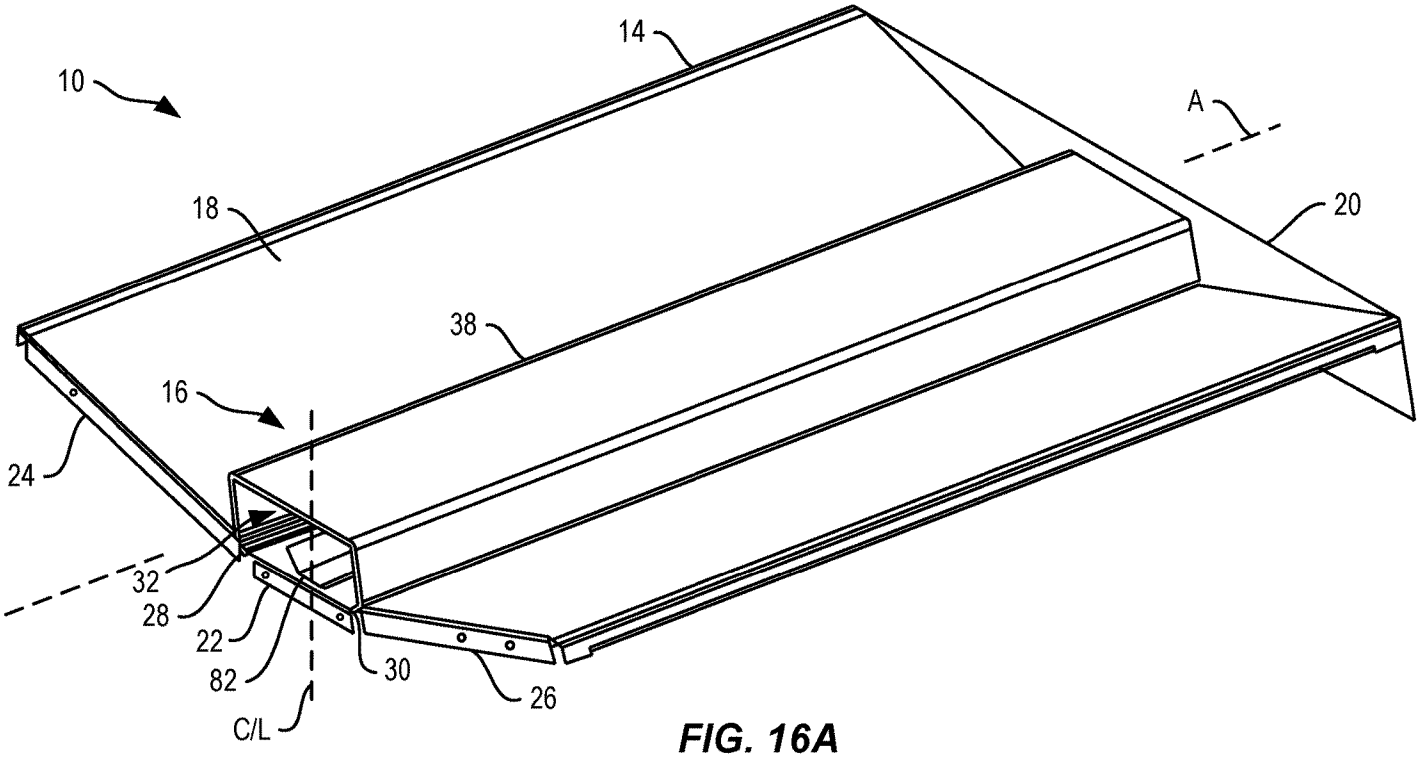
FIG. 16A is a schematic diagram of a troffer lighting fixture having a lens assembly with a lens and a reflector for redirecting light according to a fourth aspect described herein.

FIG. 16A is a schematic diagram of a troffer lighting fixture 10 having a lens assembly 16 with a lens 38 and a reflector 82 for redirecting light according to a fourth aspect described herein. Similar to the embodiments described above, the reflector 82 redirects light from the light engine 12 away from the housing 14 (e.g., downward when the lighting fixture 10 is installed in a ceiling). In particular, light rays in high v-angles (e.g., v-angles greater than 70 degrees) are reflected from the reflector 82, while light rays in lower v-angles (e.g., less than 70 degrees, less than 60 degrees, or less than 45 degrees) are emitted without redirection.

Figure 16B:
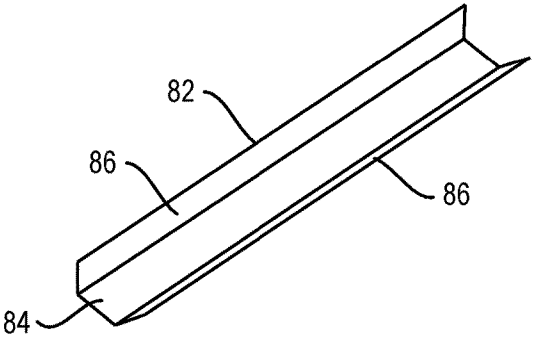
FIG. 16B is a schematic diagram of the reflector for redirecting light of FIG. 16A.

FIG. 16B is a schematic diagram of the reflector 82 for redirecting light of FIG. 16A. In some embodiments, the reflector 82 is a folded reflector having a middle 84 disposed under the light engine 12 and sides 86 extending about the light engine. The height and fold angle of the sides 86 can be adjusted to reduce shadows and provide a symmetric distribution of light from the lighting fixture 10. The reflector 82 is generally elongated and extends a length of the light engine 12 (e.g., with the sides 86 of the reflector 82 extending parallel to the elongated sides of the light engine 12).

In some embodiments, the reflector 82 is formed from separate portions, each including one of the sides 86. In one example, the reflector 82 is formed from an opaque material having a reflective surface (e.g., a diffused reflecting surface (e.g., painted, coated) or a specular reflective surface). In another example, the reflector 82 is formed from a translucent material which partially reflects and/or refracts light at the sides 86.

Figure 17A:
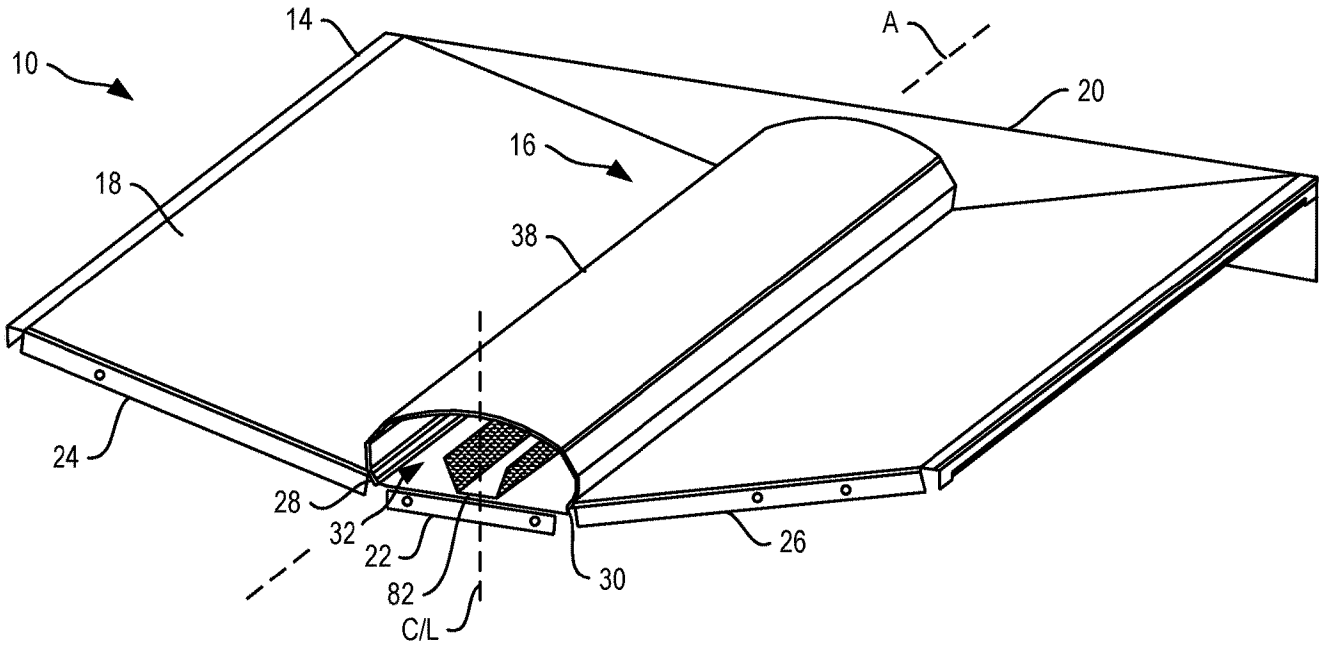
FIG. 17A is a schematic diagram of a troffer lighting fixture having a perforated reflector for redirecting light.
Figure 17B:
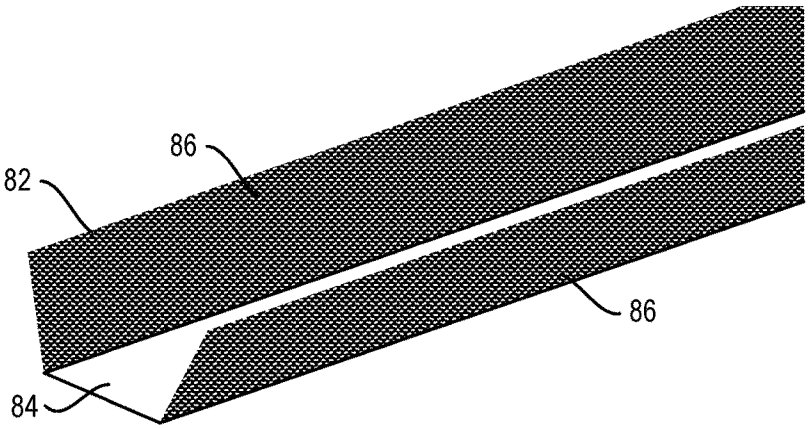
FIG. 17B is a schematic diagram of the perforated reflector for redirecting light of FIG. 17A.

FIG. 17A is a schematic diagram of a troffer lighting fixture 10 having a perforated reflector 82 for redirecting light. FIG. 17B is a schematic diagram of the perforated reflector 82 for redirecting light of FIG. 17A. By using a perforated reflector 82 (e.g., a reflector having a reflecting surface with perforations), shadows on the lens 38 may be reduced while improving (e.g., reducing) UGR. In some embodiments, the diameter and frequency of the perforations can be varied (e.g., increased in size and/or frequency) toward upper edges of the sides 86. These variations may be gradual to increase a uniform appearance of the lens 38 and/or distribution of light exiting the lighting fixture 10.

It should be understood that the above-described embodiments may be used alone or in conjunction to improve UGR. For example, the reflector 82 may be combined with the lens 38 having a prismatic inner surface 48 and/or the inner lens 58.

Those skilled in the art will recognize improvements and modifications to the preferred embodiments of the present disclosure. All such improvements and modifications are considered within the scope of the concepts disclosed herein and the claims that follow.

What is claimed is:

1. A lighting fixture, comprising:

a housing comprising a back pan, the back pan comprising a center section, and a first wing and a second wing on opposing sides of the center section;

a light engine coupled to the back pan and comprising a plurality of light emitting diode (LED) elements; and a lens assembly coupled to the center section such that the first wing and the second wing both extend away from the lens assembly, the lens assembly extending over the light engine, wherein the lens assembly is configured to redirect light from the light engine away from the housing to reduce a unified glaring ratio (UGR) of the lighting fixture, wherein the lens assembly comprises a lens with a middle section and one or more side sections that abut the middle section, the middle section comprising a first thickness and the one or more side sections comprising a second thickness and a third thickness such that the first thickness is between the second thickness and the third thickness, and a width of the middle section is larger than a width of the light engine.

2. The lighting fixture of claim 1, wherein the lens assembly is configured to reduce the UGR of the lighting fixture when viewed endwise and when viewed crosswise.

3. The lighting fixture of claim 1, wherein the lens comprises a scattering material diffused through its thickness.

4. The lighting fixture of claim 1, wherein the middle section is abutted by two side sections.

5. The lighting fixture of claim 4, wherein the two side sections are configured to redirect light in a more forward direction away from the housing than the middle section.

6. The lighting fixture of claim 1, wherein the lens comprises an elongated lens.

7. The lighting fixture of claim 6, wherein the plurality of LED elements comprises a linearly arrayed row of LED elements disposed along an elongated dimension of the elongated lens.

8. The lighting fixture of claim 7, wherein the plurality of LED elements further comprises a plurality of parallel linearly arrayed rows of LED elements.

9. The lighting fixture of claim 6, wherein a cross-section of the elongated lens across the back pan comprises a curved shape.

10. The lighting fixture of claim 6, wherein a cross-section of the elongated lens across the back pan comprises a rectangular shape.

11. The lighting fixture of claim 6, wherein a cross-section of the elongated lens across the back pan comprises an architectural shape.

12. The lighting fixture of claim 1, wherein the lens comprises a prismatic inner surface facing the light engine and configured to redirect the light from the light engine away from the housing.

13. The lighting fixture of claim 12, wherein the lens comprises a non-prismatic outer surface.

14. The lighting fixture of claim 13, wherein the prismatic inner surface is not visible when the lens is coupled to the lighting fixture.

15. The lighting fixture of claim 12, wherein the prismatic inner surface comprises an array of prismatic facets configured to redirect light from sides of the light engine in a more downward direction than at a center of the light engine when the lighting fixture is installed in a ceiling.

16. The lighting fixture of claim 15, wherein each facet of the array of prismatic facets has a triangular shape extending away from an outer surface of the lens.

17. The lighting fixture of claim 12, wherein:

the middle section comprises a non-prismatic inner surface; and the one or more side sections comprise the prismatic inner surface.

18. The lighting fixture of claim 1, wherein the lens assembly further comprises an inner lens between the lens and the light engine, wherein the inner lens is configured to redirect the light from the light engine away from the housing.

19. The lighting fixture of claim 1, wherein the lens assembly further comprises a louver assembly disposed over the light engine and configured to redirect the light from the light engine away from the housing.

20. The lighting fixture of claim 1, wherein the lens assembly further comprises a reflector disposed about the light engine and under the lens, wherein the reflector is configured to redirect the light from the light engine away from the housing.

21. The lighting fixture of claim 1, wherein the middle section of the lens comprises a flat center region, and the one or more side sections of the lens comprise lens wings that extend from the flat center region and lens sides positioned at an oblique angle with the lens wings.

22. The lighting fixture of claim 21, wherein at least one of the lens wings and the lens sides comprises a prismatic inner surface and the flat center region comprises a non-prismatic inner surface.

* * * * *